US011196140B2

(12) United States Patent
Uemichi

(10) Patent No.: US 11,196,140 B2
(45) Date of Patent: Dec. 7, 2021

(54) DIRECTIONAL COUPLER, WAVEGUIDE DEVICE, AND DIPLEXER

(71) Applicant: Fujikura Ltd., Tokyo (JP)

(72) Inventor: Yusuke Uemichi, Sakura (JP)

(73) Assignee: FUJIKURA LTD., Tokyo (JP)

( * ) Notice: Subject to any disclaimer, the term of this patent is extended or adjusted under 35 U.S.C. 154(b) by 114 days.

(21) Appl. No.: 16/611,249

(22) PCT Filed: Apr. 27, 2018

(86) PCT No.: PCT/JP2018/017133
§ 371 (c)(1),
(2) Date: Nov. 6, 2019

(87) PCT Pub. No.: WO2018/207655
PCT Pub. Date: Nov. 15, 2018

(65) Prior Publication Data

US 2020/0161736 A1 May 21, 2020

(30) Foreign Application Priority Data

May 9, 2017 (JP) ..... JP2017-093048

(51) Int. Cl.
*H01P 5/18* (2006.01)
*H01P 1/20* (2006.01)

(52) U.S. Cl.
CPC ..... *H01P 5/182* (2013.01); *H01P 1/20* (2013.01)

(58) Field of Classification Search
CPC ..... H01P 5/185; H01P 1/20
See application file for complete search history.

(56) References Cited

U.S. PATENT DOCUMENTS 3,077,565 A 2/1963 Riblet
9,831,897 B2 * 11/2017 Uemichi ..... H04B 1/0057
2016/0380330 A1 12/2016 Uemichi

FOREIGN PATENT DOCUMENTS

FR 2346868 A1 10/1977
JP S58-076201 U 5/1983
(Continued)

OTHER PUBLICATIONS

Chen Haidong et al: "Substrate integrated waveguide(SIW) 3-dB narrow wall directional couplers for monopulse comparator application", 2015 IEEE MTT-S International Microwave Workshop Series On Advanced Materials and Processes for RF and THZ Applications (IMWS-AMP), IEEE, Jul. 1, 2015, pp. 1-4 Cited in Extended European Search Report dated May 15, 2020.(4 pages).
(Continued)

*Primary Examiner* — Robert J Pascal
*Assistant Examiner* — Kimberly E Glenn
(74) *Attorney, Agent, or Firm* — Westerman, Hattori, Daniels & Adrian, LLP

(57) ABSTRACT

A directional coupler 1 includes: a first waveguide 31 and a second waveguide 32 that are arranged in parallel with post arrays 23 and 24 therebetween; a coupling window 33 that is formed in the post arrays 23 and 24 and electromagnetically couples the first waveguide 31 and the second waveguide 32; and a projecting conductor 50 that projects, at a center in a width direction of the coupling window 33, from one conductive layer 13 of paired conductive layers 12 and 13 facing each other in the first waveguide 31 and the second waveguide 32, toward an inside of the coupling window 33, the projecting conductor 50 being spaced from the other conductive layer 12.

15 Claims, 17 Drawing Sheets

(56) References Cited

FOREIGN PATENT DOCUMENTS

| | | | |
|---|---|---|---|
| JP | H11-330812 | A | 11/1999 |
| JP | 2009-044540 | A | 2/2009 |
| JP | 5172481 | B2 | 3/2013 |
| JP | 2014-179935 | A | 9/2014 |
| JP | 6042014 | B1 | 12/2016 |
| JP | 2017-11696 | A | 1/2017 |

OTHER PUBLICATIONS

Chen J-X et al.: "Development of a low cost microwave mixer using a broad-band substrate integrated waveguide (SIW) coupler" , IEEE Microwave and Wireless Components Letters, IEEE Service Center, New York, NY, US, vol. 16, No. 2, Feb. 1, 2006, pp. 84-86; Cited in Extended European Search Report dated May 15, 2020. (4 pages).

Extended (Supplementary) European Search Report dated May 15, 2020, issued in counterpart EP Application No. 18798509.8. (10 pages).

International Preliminary Report on Patentability (Form PCT/IB/373) issued in counterpart International Application No. PCT/JP2018/017133 dated Nov. 12, 2019, with Form PCT/ISA/237, with English Translation. (17 pages).

Office Action dated Dec. 9, 2020, issued in counterpart CA Application No. 3,062,784 (4 pages).

Chen, Haidong et al., "Substrate Integrated Waveguide(SIW) 3-dB Narrow Wall Directional Couplers for Monopulse Comparator Application", Jul. 1, 2015; Cited in CA Office Action dated Dec. 9, 2020.

International Search Report dated Nov. 15, 2018, issued in corresponding International Patent Application No. PCT/JP2018/017133 (3 pages).

Cheng, Yu-Liang et al., "A W-band Quadrature Hybrid Coupled Substrate Integrated Waveguide Diplexer", Dept. of ECE, National Chiao-Tung University, 1001 University Rd. Hsinchu, Taiwan, R.O.C., Institute of Electrical and Electronics Engineers, (3 pages).

Caballero, E. Diaz et al., "A Novel Transition from Microstrip to a Substrate Integrated Waveguide with Higher Characteristic Impedance", Institute of Electrical and Electronics Engineers, 2013, (5 pages).

* cited by examiner

DIRECTIONAL COUPLER, WAVEGUIDE DEVICE, AND DIPLEXER

TECHNICAL FIELD

The present disclosure relates to a directional coupler, a waveguide device, and a diplexer.

BACKGROUND ART

Known post-wall waveguide structures are manufactured at low cost by using techniques for manufacturing printed circuit boards. A conductive layer is formed on each of both sides of a dielectric substrate of such a post-wall waveguide structure, a number of aligned conductive posts (via-holes) are formed so as to penetrate through the dielectric substrate, and thereby the conductive layers on the respective sides are electrically connected to the conductive posts. An array of the conductive posts functions as a pseudo-conductive wall, and each area surrounded by the arrays of the conductive posts and the conductive layers functions as a waveguide.

Patent Literature 1 and Non-Patent Literature 1 each disclose a directional coupler using a post-wall waveguide structure. Specifically, two parallel waveguides are separated by a post array, and the interval between adjacent conductive posts in a central portion of the post array is made longer than the pitches of other conductive posts. In this way, a coupling window is formed in the central portion of the post array, the coupling window electromagnetically coupling the two waveguides.

For evaluation of performance of a directional coupler, an input reflection coefficient and a separation factor are used. The input reflection coefficient represents the ratio of the power of a signal reflected from an input port at an end of a first waveguide with respect to the power of a signal input to the input port, in level. The input reflection coefficient is an index representing ease of reflection of a signal at an input port, and the lower the input reflection coefficient is, the higher the performance of the directional coupler is. The separation factor represents the ratio of the power of a signal output from an isolation port at an end of a second waveguide of the directional coupler with respect to the power of a signal input to the input port, in level. The separation factor is an index representing ease of transmission of a signal from the input port to the isolation port, and the lower the separation factor is, the higher the isolation performance of the directional coupler is (the more difficult the transmission of a signal to the isolation port is) and hence the directional coupler has higher performance.

CITATION LIST

Patent Literature

[Patent Literature 1] Japanese Patent No. 5172481

Non-Patent Literature

Non-Patent Literature 1: Yu-Liang Cheng, Hung-Wei Chen, Peng-Da Huang, and Chi-Yang Chang, "A W-band Quadrature Hybrid Coupled Substrate Integrated Waveguide Diplexer", in Proc. Asia-Pacific Microw. Conf., pp. 1-3, December 2015

SUMMARY OF INVENTION

Technical Problem

Improvement of performance of a directional coupler is desired. In view of this, an object of the present disclosure is to improve performance of a directional coupler, specifically, to lower an input reflection coefficient and a separation factor of the directional coupler.

Solution to Problem

A primary aspect of the present disclosure to achieve the aforementioned object is a directional coupler including: a first waveguide and a second waveguide that are arranged in parallel with a narrow wall therebetween; a coupling window that is formed in the narrow wall and electromagnetically couples the first waveguide and the second waveguide; and a projecting conductor that projects, at a center in a width direction of the coupling window, from one wide wall of paired wide walls facing each other in the first waveguide and second waveguide, toward an inside of the coupling window, the projecting conductor being spaced from the other wide wall of the paired wide walls.

Other features of the present disclosure are made clear by the following description and the drawings.

Advantageous Effects of Invention

According to embodiments of the present disclosure, it is possible to lower an input reflection coefficient and a separation factor of a directional coupler.

DESCRIPTION OF EMBODIMENTS

Figure 1:
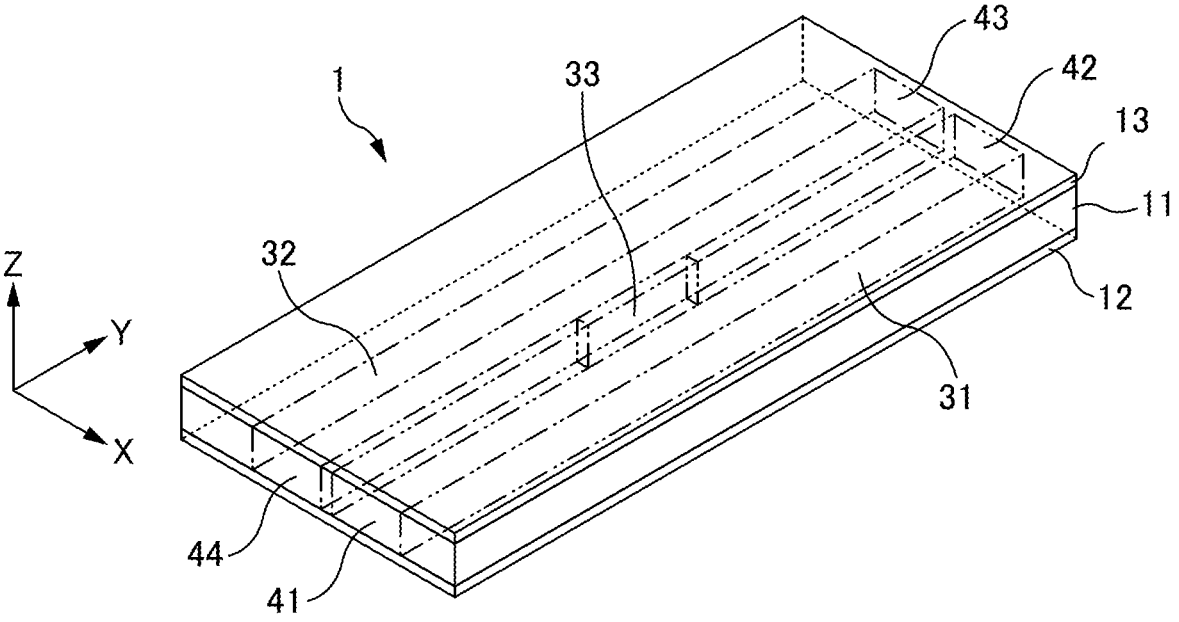
FIG. 1 is a perspective view of a directional coupler according to a first embodiment.

At least the following matters are made clear from the following description and the drawings.

A directional coupler is made clear, the directional coupler comprising: a first waveguide and a second waveguide that are arranged in parallel with a narrow wall therebetween; a coupling window that is formed in the narrow wall and electromagnetically couples the first waveguide and the second waveguide; and a projecting conductor that projects, at a center in a width direction of the coupling window, from one wide wall of paired wide walls facing each other in the first waveguide and second waveguide, toward an inside of the coupling window, the projecting conductor being spaced from the other wide wall of the paired wide walls.

With such a directional coupler, an input reflection coefficient and a separation factor are low, thereby improving the degree of electromagnetic coupling between the first waveguide and the second waveguide through the coupling window.

The directional coupler further comprises: a dielectric; a first conductive layer and a second conductive layer that face each other with the dielectric therebetween; and three post arrays that penetrate through the dielectric and are electrically connected to the first conductive layer and the second conductive layer, the three post arrays being arranged in parallel to each other, the post arrays each being formed of a plurality of conductive posts, wherein areas, each between post arrays adjacent to each other in the three post arrays, are the first waveguide and the second waveguide, respectively, the first conductive layer and the second conductive layer are the paired wide walls, a central post array in the three post arrays is the narrow wall, and the coupling window is formed in the central post array such that an interval between conductive posts adjacent to each other at a center in an array direction of the central post array is made longer than a pitch between other conductive posts.

With such a directional coupler, it is possible to manufacture the directional coupler by using a technique for manufacturing a printed circuit board.

The directional coupler further comprises: paired first conductive projections formed at positions that are respectively closer to two ends of the first waveguide than the coupling window is and that are symmetric with respect to the coupling window, in the narrow wall, the first projections projecting from the narrow wall toward an inside of the first waveguide; and paired second conductive projections formed at positions that are respectively closer to two ends of the second waveguide than the coupling window is and that are symmetric with respect to the coupling window, in the narrow wall, the second projections projecting from the narrow wall toward an inside of the second waveguide.

The first projections extend from one wide wall of the paired wide walls facing each other of the first waveguide toward the other wide wall, to be electrically connected to the one wide wall, and to be spaced from the other wide wall, and the second projections extend from one wide wall of the paired wide walls facing each other of the second waveguide toward the other wide wall, to be electrically connected to the one wide wall and to be spaced from the other wide wall.

The directional coupler further comprises: a first conductive central projection that projects from a position facing the center in the width direction of the coupling window, in a narrow wall opposite to the narrow wall across the first waveguide, toward the inside of the first waveguide; and a second conductive central projection that projects from a position facing the center in the width direction of the coupling window, in a narrow wall opposite to the narrow wall across the second waveguide, toward the inside of the second waveguide.

The above-described directional coupler has a low input reflection coefficient and a low separation factor.

The directional coupler further comprises: a first tapered waveguide and a second tapered waveguide that are respectively connected to an end portion of the first waveguide and an end portion of the second waveguide, wherein a height of the first tapered waveguide is equal to a height of the first waveguide, and a width of the first tapered waveguide gradually increases with distance from the first waveguide, and a height of the second tapered waveguide is equal to a height of the second waveguide, and a width of the second tapered waveguide gradually increases with distance from the second waveguide.

With the above-described directional coupler, it is possible to connect a waveguide or a port having a width greater than the width of the first waveguide to an end portion of the first waveguide via a first tapered rectangular waveguide. It is also possible to connect a waveguide or a port having a greater width to an end portion of the second waveguide.

A waveguide device is made clear, the waveguide device comprising: the directional coupler; and a short-circuit conductor that short-circuits end portions of the first waveguide and the second waveguide, the end portions being on a same side.

With the above waveguide device, a signal input to an end portion that is not short-circuited in the first waveguide is transmitted to an end portion that is not short-circuited in the second waveguide, and then output from the end portion.

A diplexer is made clear, the diplexer comprising: two directional couplers each being the directional coupler; a first band-pass filter that is inserted between a first waveguide of one of the two directional couplers and a first waveguide of the other of the directional couplers; and a second band-pass filter that is inserted between a second waveguide of the one directional coupler and a second waveguide of the other directional coupler.

Embodiments

Embodiments of the present disclosure are described below with reference to the drawings. Note that, although various limitations that are technically preferable for carrying out the present disclosure are imposed on the embodiments to be described below, the scope of the present disclosure is not to be limited to the embodiments below and illustrated examples.

First Embodiment

Figure 2:
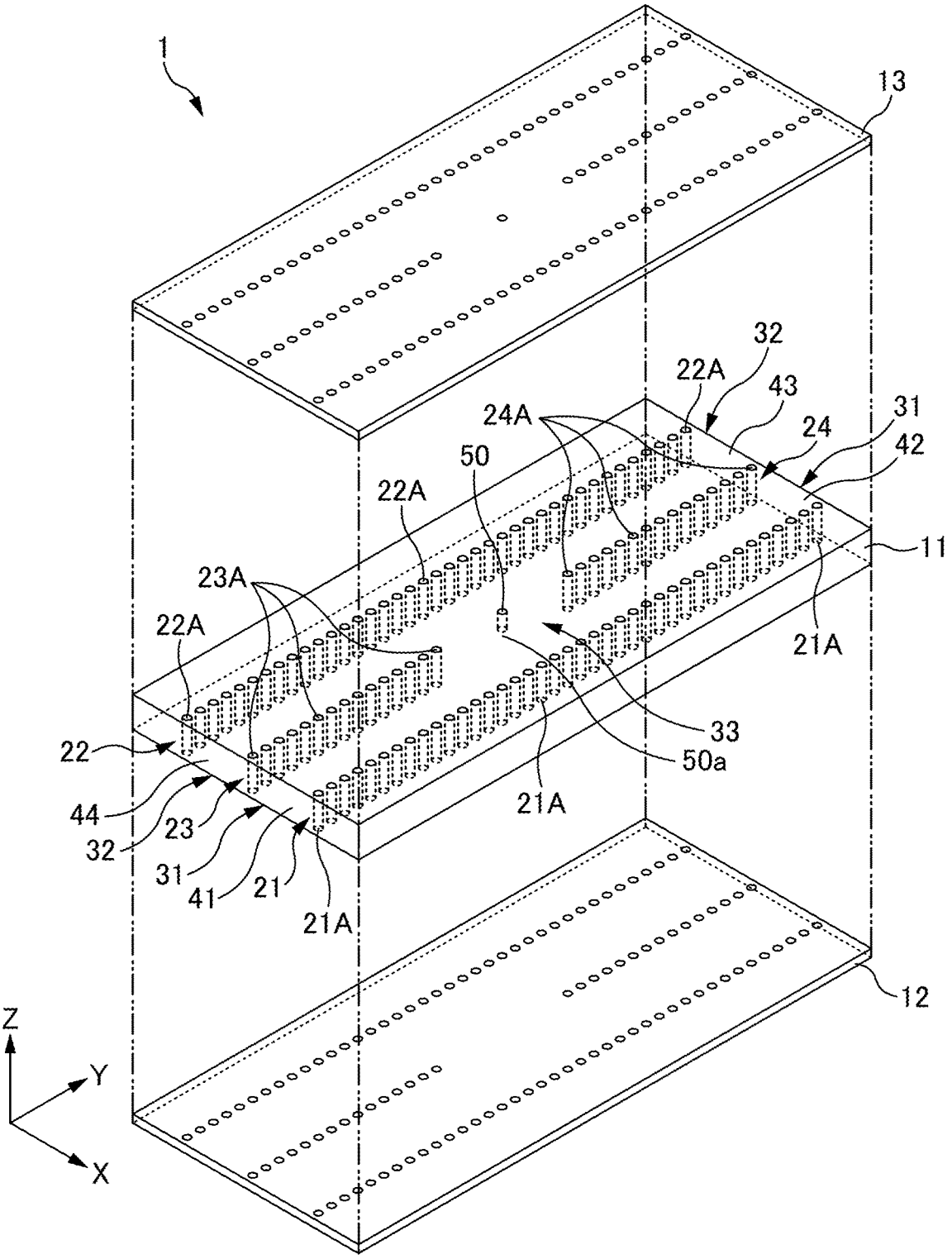
FIG. 2 is an exploded perspective view of the directional coupler according to the first embodiment.

FIG. 1 is a perspective view of an external appearance of a directional coupler 1, and FIG. 2 is an exploded perspective view of the directional coupler 1. In FIG. 1, waveguides 31 and 32 and a coupling window 33 formed inside the directional coupler 1 are illustrated by chain double-dashed lines. In the drawing, an X axis, a Y axis, and a Z axis are illustrated as auxiliary lines representing directions. The X axis, the Y axis, and the Z axis are orthogonal to each other.

The directional coupler 1 includes a first waveguide 31 and a second waveguide 32 arranged in parallel, a narrow wall (post arrays 23 and 24) separating the waveguides 31 and 32, a coupling window 33, which is formed in the narrow wall, and a projecting conductor 50 formed at the center in the width direction of the coupling window 33. The first waveguide 31 is formed between a post array 21 formed in a dielectric substrate 11 and the post arrays 23 and 24, and the second waveguide 32 is formed between a post array 22 formed in the dielectric substrate 11 and the post arrays 23 and 24. Detailed descriptions are given below of the dielectric substrate 11, the post arrays 21 to 24, the first waveguide 31, the second waveguide 32, the coupling window 33, the projecting conductor 50, and the like.

The dielectric substrate 11 is a flat rectangular plate made of quartz glass. A first conductive layer 12 is formed on one face of the dielectric substrate 11, and a second conductive layer 13 is formed on the other face of the dielectric substrate 11. The first conductive layer 12 and the second conductive layer 13 are provided so as to face each other with the dielectric substrate 11 therebetween and be also in parallel to each other. Note that both the faces of the dielectric substrate 11 are parallel to the X axis and the Y axis, and the direction of the thickness of the dielectric substrate 11 is parallel to the Z axis.

Conductive posts 21A to 24A penetrate through the dielectric substrate 11 from the one face to the other face of the dielectric substrate 11. In this way, the first conductive layer 12 and the second conductive layer 13 are electrically connected to the conductive posts 21A to 24A. The conductive posts 21A to 24A are metalized through holes or via-holes. All the conductive posts 21A to 24A are equal in diameter. In addition, since the conductive layers 12 and 13 are parallel to each other, the conductive posts 21A to 24A are also equal in height.

The conductive posts 21A are linearly arranged at equal pitches from one endface to an opposite endface of the dielectric substrate 11 to form the post array 21. Here, in FIG. 1 and FIG. 2, the array direction of the post array 21 is parallel to the Y axis, and it is assumed that the negative direction of the Y axis is the front of array while the positive direction of the Y axis is the rear of array. This similarly applies to the post arrays 22 to 24 to be described later.

The conductive posts 22A are linearly arranged, at equal pitches, in parallel to the post array 21 to form the post array 22. The post array 22 and the post array 21 are equal in pitches. The post array 21 and the post array 22 are equal in array length, and the beginning of the post array 22 is aligned, in position in the array-direction, with the beginning of the post array 21, while the end of the post array 21 is aligned, in position in the array-direction, with the end of the post array 22.

The conductive posts 23A are linearly arranged, at equal pitches, between the post array 21 and the post array 22 in parallel to the post arrays 21 and 22 to form the post array 23. The post array 23 is equal, in pitches, to the post arrays 21 and 22. The beginning of the post array 23 is aligned, in position in the array-direction, with the beginnings of the post arrays 21 and 22, and the post array 23 is shorter in array length than the post arrays 21 and 22.

The conductive posts 24A are linearly arranged, at equal pitches, between the post array 21 and the post array 22 in parallel to the post arrays 21 and 22 to form the post array 24. The post array 24 is equal, in pitches, to the post arrays 21 to 23. The end of the post array 24 is aligned, in position in the array-direction, with the ends of the post arrays 21 and 22, and the post array 24 is shorter in array length than the post arrays 21 and 22.

The post array 21 functions as a pseudo-conductive wall. This similarly applies to the post array 22.

The post arrays 23 and 24 function as a pseudo-conductive wall. The pitch between the end of the post array 23 and the beginning of the post array 24 is greater than each of the pitches of the post arrays 23 and 24 and hence the interval between the end of the post array 23 and the beginning of the post array 24 functions as the rectangular coupling window 33 formed in the pseudo-conductive wall with the post arrays 23 and 24. Here, the height of the coupling window 33 is equal to the height of the conductive posts 21A to 24A, i.e., the interval between the conductive layers 12 and 13. The width of the coupling window 33 is equal to the interval from the end of the post array 23 to the beginning of the post array 24. The thickness of the coupling window 33 is equal to the thickness of the pseudo-conductive wall formed of the post arrays 23 and 24, i.e., the diameter of the conductive posts 23A and 24A.

At the midpoint between the end of the post array 23 and the beginning of the post array 24, the projecting conductor 50 is formed. The projecting conductor 50 projects from the second conductive layer 13 toward the inside of the coupling window 33 to extend halfway through the dielectric substrate 11 in the thickness direction of the dielectric substrate 11. A space 50*a* exists between the tip of the projecting conductor 50 and the first conductive layer 12. For this reason, the projecting conductor 50 is electrically connected to the second conductive layer 13 while not being electrically connected to the first conductive layer 12. The projecting conductor 50 is a metalized blind via-hole.

The area surrounded by the post array 21, the post arrays 23 and 24, and the conductive layers 12 and 13 forms the first waveguide 31 of rectangular waveguide type for propagating electromagnetic waves. The area surrounded by the post array 22, the post arrays 23 and 24, and the conductive layers 12 and 13 forms the second waveguide 32 of rectangular waveguide type for propagating electromagnetic waves. The first waveguide 31 and the second waveguide 32 are plane-symmetric with respect to the conductive wall formed of the post arrays 23 and 24.

Here, since the interval between the post array 21 and the post arrays 23 and 24 is greater than the height of the conductive posts 21A to 24A, the conductive wall formed of the post array 21 and the conductive wall formed of the post arrays 23 and 24 serve as paired narrow walls of the first waveguide 31 while the conductive layer 12 and the conductive layer 13 serve as paired wide walls of the first waveguide 31. Similarly, the conductive wall formed of the post array 22 and the conductive wall formed of the post arrays 23 and 24 serve as paired narrow walls of the second waveguide 32 while the conductive layer 12 and the conductive layer 13 serve as paired wide walls of the second waveguide 32.

The first waveguide 31 and the second waveguide 32 are separated by the narrow wall formed of the post arrays 23 and 24. The first waveguide 31 and the second waveguide 32 share the narrow wall formed of the post arrays 23 and 24. The coupling window 33 is formed in the narrow wall formed of the post arrays 23 and 24, and the first waveguide 31 and the second waveguide 32 are electromagnetically coupled through the coupling window 33. Hence, the directional coupler 1 is a directional coupler using H-plane coupling.

The endfaces of the dielectric substrate 11 on the positive direction side and the negative direction side in the Y axis are not covered with conductors. Hence, ends 41 to 44 of the waveguides 31 and 32 serve as ports for coupling the waveguides 31 and 32 to the outside electrically or magnetically. Here, the one end 41 of the first waveguide 31 is referred to as a first port 41, and the other end of the first waveguide 31 is referred to as a second port 42. The one end 43, located on the second port 42 side of the first waveguide 31, of both the ends 43 and 44 of the second waveguide 32 is referred to as a third port 43, and the other end 44 of the second waveguide 32 is referred to as a fourth port 44. In a case that the first port 41 is an input port, the second port 42 is an output port, the third port 43 is a coupling port, and the fourth port 44 is an isolation port.

Next, descriptions are given of the width of the waveguides 31 and 32 and the width of the coupling window 33 (interval from the end of the post array 23 to the beginning of the post array 24). The width of the waveguides 31 and 32 and the width of the coupling window 33 are designed as follows.

Assume that the waveguides 31 and 32 are rectangular waveguides. In this case, a cut-off frequency $f_c$ [Hz] and a cut-off wavelength $\lambda_c$ [m] of fundamental mode ($TE_{10}$ mode) of electromagnetic waves propagated through the waveguides 31 and 32 are expressed by the following equations, respectively.

[Math 1]

$$\lambda_c = 2a \tag{1}$$

$$f_c = \frac{v}{2a} = \frac{c}{2a\sqrt{\mu_R \varepsilon_R}} \tag{2}$$

Where a denotes the width [m] of the waveguides 31 and 32, v denotes the speed [m/s] of an electromagnetic wave propagated through the dielectric substrate 11, c denotes the speed [m/s] of light, $\mu_R$ denotes the relative permeability of the dielectric substrate 11, and $\varepsilon_R$ denotes the relative permittivity of the dielectric substrate 11.

Assume that the free-space wavelength of an electromagnetic wave is $\lambda_0$ [m], the wavelength $\lambda$ and the frequency f of the electromagnetic wave in a dielectric with the relative permeability $\mu_R$ and the relative permittivity $\varepsilon_R$ are expressed by the following equations.

[Math 2]

$$\lambda = \frac{\lambda_0}{\sqrt{\mu_R \varepsilon_R}} \tag{3}$$

$$f = \frac{v}{\lambda} \tag{4}$$

In a case that an electromagnetic wave of the free-space wavelength $\lambda_0$ enters the waveguides 31 and 32, the guide wavelength $\lambda_g$ [m] in the waveguides 31 and 32 are expressed by the following equation.

[Math 3]

$$\lambda_g = \frac{\lambda_0}{\sqrt{\mu_R \varepsilon_R - \left(\frac{\lambda_0}{\lambda_c}\right)^2}} = \frac{\lambda}{\sqrt{1 - \left(\frac{f_c}{f}\right)^2}} = \frac{v}{f \times \sqrt{1 - \left(\frac{f_c}{f}\right)^2}} \tag{5}$$

The width a of the waveguides 31 and 32 are designed such that the center frequency of the frequency band of electromagnetic waves to be used by the directional coupler 1 will be 1.25 times as high as the cut-off frequency $f_c$. Here, the frequency band to be used is a band defined by the following (1) to (3), for example.

(1) A band where, in the frequency characteristics representing the separation factor of each frequency of the directional coupler 1, the separation factor is −20 [dB] or lower or −30 [dB] or lower (2) A band where, in the frequency characteristics representing the input reflection coefficient of each frequency of the directional coupler 1, the input reflection coefficient is −10 [dB] or lower (3) A band between a first frequency and a second frequency where, in the frequency characteristics representing the input reflection coefficient and the insertion loss of each frequency of the directional coupler 1, the input reflection coefficient and the insertion loss are equal to each other The separation factor represents, in a case of inputting a signal to the input port, the ratio of the power of an output signal from the isolation port to the power of the input signal to the input port, in level. The input reflection coefficient represents, in a case of inputting a signal to the input port, the ratio of the power of a reflected signal from the input port to the power of the input signal to the input port, in level. The degree of coupling represents, in a case of inputting a signal to the input port, the ratio of the power of an output signal from the coupling port to the power of the input signal to the input port, in level. The insertion loss represents, in a case of inputting a signal to the input port, the ratio of the power of an output signal from the output port to the power of the input signal to the input port, in level. Here, the input reflection coefficient, the insertion loss, the degree of coupling, and the separation factor are represented using S parameters and correspond to |S11|, |S12|, |S13|, and |S14|, respectively.

In a case that the center frequency (f) of the frequency band of the electromagnetic waves to be used by the directional coupler 1 enter the waveguides 31 and 32, the guide wavelength ($\lambda_g$) is obtained by Equation (5). The width of the coupling window 33, i.e., the interval from the end of the post array 23 to the beginning of the post array 24, is designed based on the guide wavelength ($\lambda_g$). More specifically, the width of the coupling window 33 is designed to be 53.4% of the guide wavelength ($\lambda_g$) or a value close thereto.

Next, a function of the directional coupler 1 is described.

In a case that a high-frequency signal is input to the first port 41 of the directional coupler 1, the high-frequency signal is transmitted through the first waveguide 31 and then output from the second port 42. Moreover, the high-frequency signal coupled with the second waveguide 32 through the coupling window 33 is transmitted through the second waveguide 32 and then output from the third port 43. In this way, the directional coupler 1 functions as a demultiplexer that outputs, from two ports, a high-frequency signal having been input to one port.

The high-frequency signal output from the second port 42 and the high-frequency signal output from the third port 43 have a phase difference of 90°. Hence, the directional coupler 1 functions as a 90-degree hybrid coupler.

In a case that a first high-frequency signal is input to the second port 42 and a second high-frequency signal having a phase difference of 90° with respect to the first high-frequency signal is input to the third port 43, a signal obtained by multiplexing the first high-frequency signal and the second high-frequency signal is output from the first port 41 or the fourth port 44. In this way, the directional coupler 1 also functions as a multiplexer that outputs, from one port, high-frequency signals having been input to two respective ports.

Since the projecting conductor 50 is provided in the coupling window 33 as described above, the directional coupler 1 has high isolation performance and a low separation factor. Moreover, the directional coupler 1 has a high degree of coupling. Specifically, a high-frequency signal is hardly transmitted from the input port (first port 41) to the isolation port (fourth port 44), and at the same time a high-frequency signal is readily transmitted from the input port to the coupling port (third port 43) (refer to Verification 1). This is considered such that the electromagnetic waves passing through the coupling window 33 are diffracted by the projecting conductor 50 and the diffraction phenomenon acts effectively. Specifically, it is considered that the diffraction phenomenon acts in the direction of canceling the electromagnetic waves going to the isolation port and also acts in the direction of coupling the electromagnetic waves going to the coupling port.

Moreover, the projecting conductor 50 is electrically connected to the second conductive layer 13 while being spaced from the first conductive layer 12, and thus the coupling window 33 is not separated by the projecting conductor 50 to thereby maintain the width of the coupling window 33. Hence, the above-described diffraction phenomenon can occur.

Second Embodiment

Figure 3:
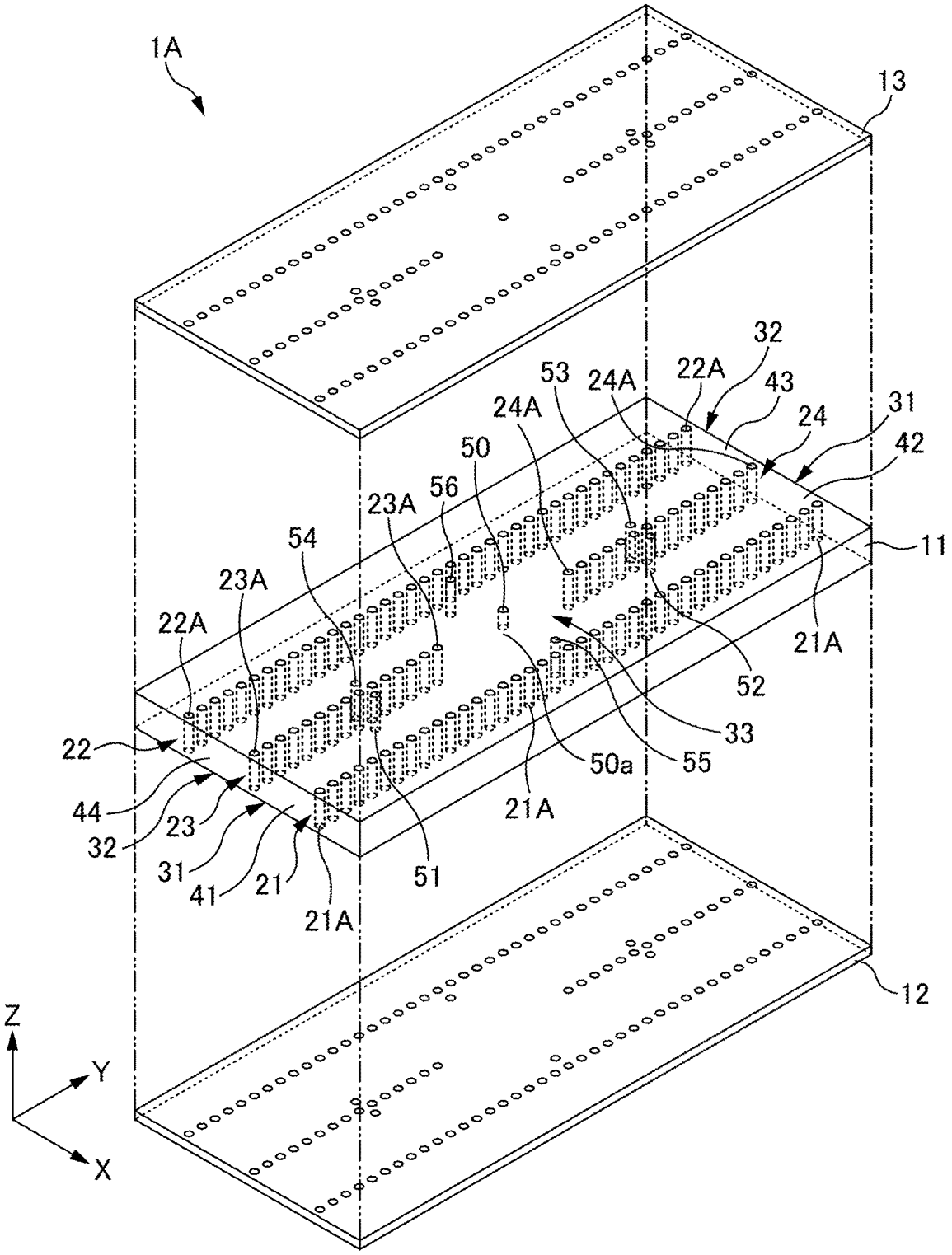
FIG. 3 is an exploded perspective view of a directional coupler according to a second embodiment.

FIG. 3 is an exploded perspective view of a directional coupler 1A.

The directional coupler 1A is formed by adding additional conductive posts 51 to 56 to the directional coupler 1 illustrated in FIG. 1 and FIG. 2. These additional conductive posts 51 to 56 penetrate through the dielectric substrate 11 from one face to the other face of the dielectric substrate 11 and also are electrically connected to the first conductive layer 12 and the second conductive layer 13. The additional conductive posts 51 to 56 are metalized through holes or via-holes.

Positions at which the additional conductive posts 51 to 54 are formed are described.

The additional conductive post 51 is arranged in the first waveguide 31, and the additional conductive post 54 is arranged in the second waveguide 32. The additional conductive post 51 and the additional conductive post 54 are arranged to be adjacent to the post array 23 in the direction orthogonal to the array direction of the post array 23. Accordingly, the additional conductive post 51 functions as a conductive projection (first projection) projecting from the narrow wall formed of the post array 23 toward the inside of the first waveguide 31, and the additional conductive post 54 functions as a conductive projection (second projection) projecting from the narrow wall formed of the post array 24 toward the inside of the second waveguide 32.

The additional conductive post 51 and the additional conductive post 54 are arranged at positions plane-symmetric with respect to the conductive wall formed of the post array 23.

The additional conductive post 52 is arranged in the first waveguide 31, and the additional conductive post 53 is arranged in the second waveguide 32. The additional conductive post 52 and the additional conductive post 53 are arranged to be adjacent to the post array 24 in the direction orthogonal to the array direction of the post array 24. Accordingly, the additional conductive post 52 functions as a conductive projection (first projection) projecting from the conductive wall formed of the post array 24 toward the inside of the first waveguide 31, and the additional conductive post 53 functions as a conductive projection (second projection) projecting from the conductive wall formed of the post array 24 toward the inside of the second waveguide 32.

The additional conductive post 52 and the additional conductive post 53 are arranged at positions plane-symmetric with respect to the conductive wall formed of the post array 24.

The distance between the additional conductive posts 52 and 53 to the beginning of the post array 24 is equal to the distance from the additional conductive posts 51 and 54 to the end of the post array 23. In other words, the additional conductive post 51 and the additional conductive post 52 are arranged at positions plane-symmetric with respect to a symmetry plane orthogonal to the array direction of the post arrays 21 to 24 and passing through the center of the coupling window 33. This similarly applies to the additional conductive post 53 and the additional conductive post 54.

Since the additional conductive posts 52 to 54 are formed, the input reflection coefficient and the isolation performance in the frequency band used by the directional coupler 1A can be improved.

Positions at which the additional conductive posts 55 and 56 are formed are described.

The additional conductive post 55 is arranged in the first waveguide 31. The additional conductive post 55 is arranged to be adjacent to the post array 21 in the direction orthogonal to the array direction of the post array 21. Accordingly, the additional conductive post 55 functions as a conductive projection (first central projection) projecting from a position, facing the projecting conductor 50, in the narrow wall formed of the post array 21 toward the inside of the waveguide 31.

The additional conductive post 56 is arranged in the second waveguide 32. The additional conductive post 56 is arranged to be adjacent to the post array 22 in the direction orthogonal to the array direction of the post array 22. Accordingly, the additional conductive post 56 functions as a conductive projection (second central projection) projecting from a position, facing the projecting conductor 50, in the narrow wall formed of the post array 22 toward the inside of the second waveguide 32.

The additional conductive posts 55 and 56 are arranged on a plane orthogonal to the array direction of the post arrays 21 to 24 and passing through the center of the coupling window 33. In other words, the additional conductive posts 55 and 56 are arranged to face each other with the center of the coupling window 33 therebetween.

At the midpoint between the additional conductive post 55 and the additional conductive post 56, the above-described projecting conductor 50 is arranged. In other words, the additional conductive post 55 and the additional conductive post 56 are arranged at positions plane-symmetric with respect to the narrow wall formed of the post arrays 23 and 24.

Since the additional conductive posts 55 to 56 are formed, the input reflection coefficient in the frequency band used by the directional coupler 1A can be improved.

Since the projecting conductor 50 is provided in the coupling window 33 also in the above-described directional coupler 1A, the directional coupler 1 has high isolation performance and a high degree of coupling (refer to Verification 1).

Note that the additional conductive posts 51 to 54 may be formed without the additional conductive posts 55 and 56 being formed. Alternatively, the additional conductive posts 55 and 56 may be formed without the additional conductive posts 51 to 54 being formed.

The additional conductive posts 51 to 56 may be metalized blind via-holes instead of through holes or via-holes. Specifically, the additional conductive posts 51 to 56 project from the second conductive layer 13 toward the first conductive layer 12 without reaching the first conductive layer 12. Hence, there exists a space between each of the additional conductive posts 51 to 56 and the first conductive layer 12. This brings the additional conductive posts 51 to into direct electrical connection with the second conductive layer 13 while not bringing the additional conductive posts 51 to 56 into direct electrical connection with the first conductive layer 12.

Third Embodiment

Figure 4:
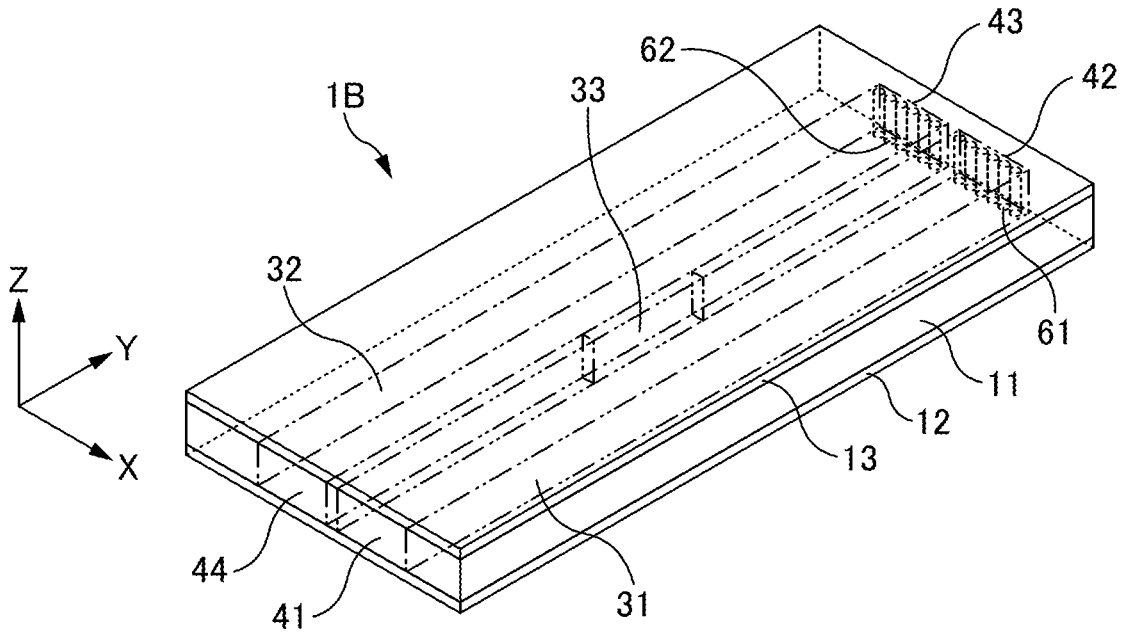
FIG. 4 is a perspective view of a waveguide device using a directional coupler according to a third embodiment.

FIG. 4 is a perspective view of an external appearance of a waveguide device 1B. The waveguide device 1B is formed by short-circuiting the ports 42 and 43 on the same side of the waveguides 31 and 32 of the directional coupler 1 using post arrays. Note that, in FIG. 4, waveguides 31 and 32 and coupling window 33 formed inside the waveguide device 1B are illustrated by chain double-dashed lines, and illustrations of post arrays 21 to 24 (refer to FIG. 2) and a projecting conductor 50 (refer to FIG. 2) are omitted.

Specifically, a plurality of conductive posts 61 penetrating through a dielectric substrate 11 are arranged from the end of the post array 21 to the end of the post array 24, and the conductive posts 61 are electrically connected to conductive layers 12 and 13, to thereby short-circuit a second port 42 of the first waveguide 31. Similarly, a plurality of conductive posts 62 penetrating through the dielectric substrate 11 are arranged from the end of the post array 22 to the end of the post array 24, and the conductive posts 62 are electrically connected to the conductive layers 12 and 13, to thereby short-circuit a third port 43 of the second waveguide 32.

Note that the ports 42 and 43 of the waveguides 31 and 32 may be short-circuited by a conductive layer instead of being short-circuited by the arrays of the conductive posts 61 and 62. Specifically, the conductive layer may be formed on an endface of the dielectric substrate 11 (the endface corresponding to the ports 42 and 43 of the waveguide 31), to thereby short-circuit the ports 42 and 43 of the waveguides 31 and 32 using the conductive layer.

Next, a function of the waveguide device 1B is described. In a case that a high-frequency signal is input to a first port 41 of the waveguide device 1B, the high-frequency signal is output from a fourth port 44. This is described below more specifically.

The high-frequency signal input to the first port 41 is propagated through the first waveguide 31 and then reflected from the array of the conductive posts 61 at the second port 42. The high-frequency signal input to the first port 41 is also propagated through the second waveguide 32 through the coupling window 33 and then reflected from the array of the conductive posts 62 at the third port 43. A reflected signal at the third port 43 has a phase difference of 90° with respect to a reflected signal at the second port 42. Consequently, the reflected signal at the second port 42 and the reflected signal at the third port 43 are multiplexed, and the signal obtained through the multiplexing is output from the fourth port 44.

Note that, in FIG. 4, the ports 42 and 43 of the waveguides 31 and 32 of the directional coupler 1 illustrated in FIG. 1 are short-circuited. Similarly, the ports 42 and 43 of the waveguides 31 and 32 of the directional coupler 1A illustrated in FIG. 3 may be short-circuited.

Fourth Embodiment

Figure 5:
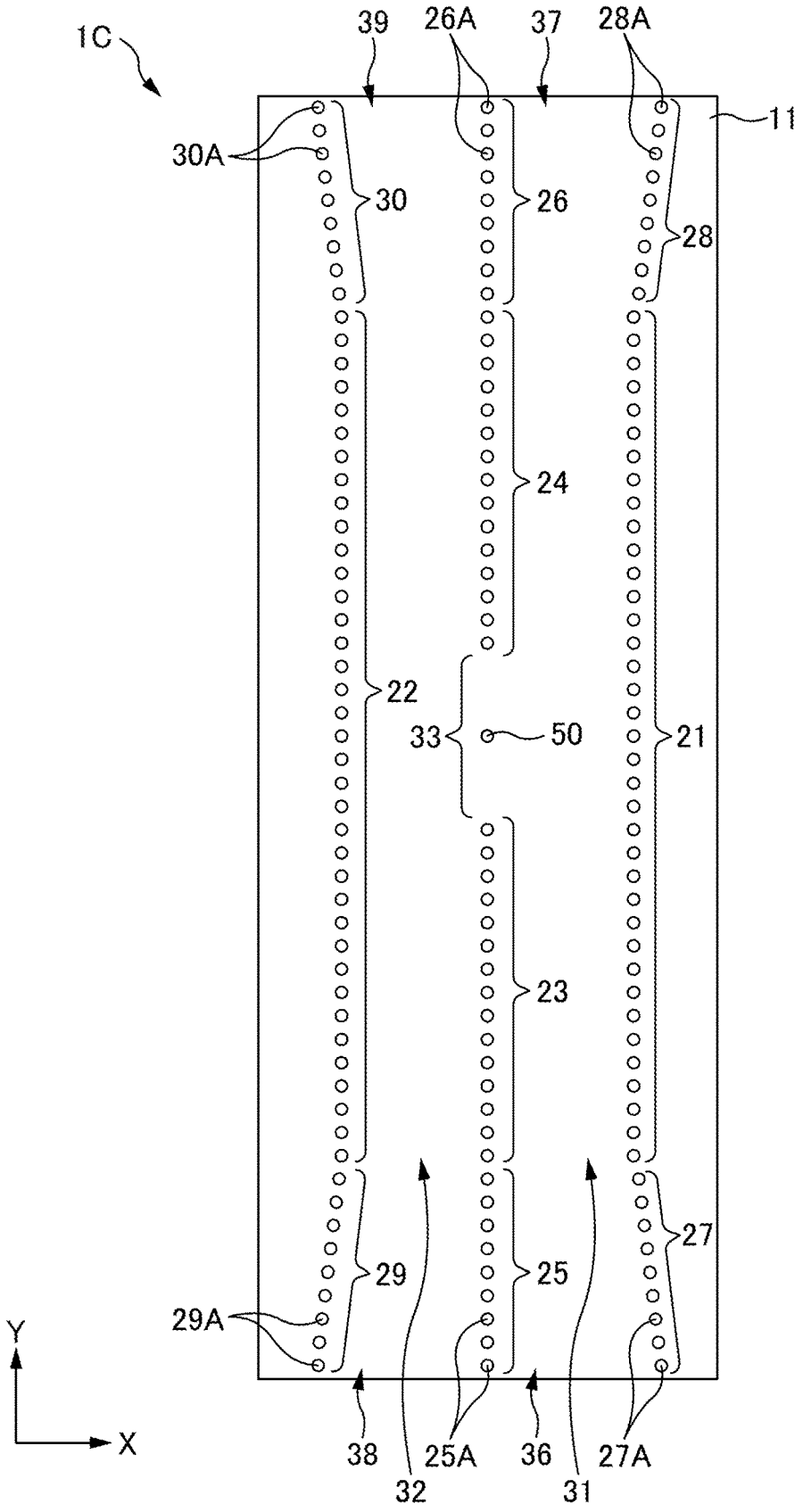
FIG. 5 is a cross-sectional view of a directional coupler according to a fourth embodiment.

FIG. 5 is a cross-sectional view of a directional coupler 1C at a section parallel to both faces of a dielectric substrate 11. The directional coupler 1C is formed by extending the waveguides 31 and 32 of the directional coupler 1 in both directions by using post arrays 25 to 30. This is specifically described below.

The dielectric substrate 11 and conductive layers 12 and 13 (illustrations omitted in FIG. 5) extend further forward from beginnings of post arrays 21 to 23 and also extend further rearward from ends of the post arrays 21, 22, and 24.

A plurality of conductive posts 25A are linearly arranged contiguously from the beginning of the post array 23, to form the post array 25. The post array 25 and the post array 23 are arranged in series. A plurality of conductive posts 26A are linearly arranged contiguously from the end of the post array 24, to form the post array 26. The post array 26 and the post array 24 are arranged in series.

The plurality of conductive posts 27A are linearly arranged contiguously from the beginning of the post array 21 to be oblique with respect to the post array 21 in a direction away from the post array 25. In this way, the conductive posts 27A form a post array 27. The interval between the post array 27 and the post array 25 gradually increases toward the front of array.

The plurality of conductive posts 28A are linearly arranged contiguously from the end of the post array 21 to be oblique with respect to the post array 21 in a direction away from the post array 26. In this way, the conductive posts 28A form the post array 28. The interval between the post array 28 and the post array 26 gradually increases toward the rear of array.

The plurality of conductive posts 29A are linearly arranged contiguously from the beginning of the post array 22 to be oblique with respect to the post array 22 in a direction away from the post array 25. In this way, the conductive posts 29A form the post array 29. The interval between the post array 29 and the post array 25 gradually increases toward the front of array.

The plurality of conductive posts 30A are linearly arranged contiguously from the end of the post array 22 to be oblique with respect to the post array 22 in a direction away from the post array 26. In this way, the conductive posts 29A form the post array 29. The interval between the post array 29 and the post array 26 gradually increases toward the rear of array.

The conductive posts 25A to 30A penetrate through the dielectric substrate 11 from one face to the other face of the dielectric substrate 11 and also are electrically connected to the conductive layers 12 and 13.

The post array 25 functions as a pseudo-conductive wall. This similarly applies to the post arrays 26 to 30.

The area surrounded by the post array 25, the post array 27, and the conductive layers 12 and 13 forms a waveguide 36 of tapered rectangular waveguide type that is connected to one end of the first waveguide 31. The area surrounded by the post array 26, the post array 28, and the conductive layers 12 and 13 forms a waveguide 37 of tapered rectangular waveguide type that is connected to the other end of the first waveguide 31.

The area surrounded by the post array 25, the post array 29, and the conductive layers 12 and 13 forms a waveguide 38 of tapered rectangular waveguide type that is connected to one end of the second waveguide 32. The area surrounded by the post array 26, the post array 30, and the conductive layers 12 and 13 forms a waveguide 39 of tapered rectangular waveguide type that is connected to the other end of the second waveguide 32.

Widths of the waveguides 31 and 32 are designed based on the center frequency of the band to be used. Since the waveguides 36 to 39 are connected to the waveguides 31 and 32, waveguides that are greater in width than the waveguides 31 and 32 can be connected to the waveguides 31 and 32 by using the waveguides 36 to 39. Moreover, high-frequency circuits having ports wider than those of the waveguides 31 and 32 can be connected to the waveguides 31 and 32 by using the waveguides 36 to 39.

Note that, in FIG. 5, the waveguides 31 and 32 of the directional coupler 1 illustrated in FIG. 1 are extended in both directions by the post arrays 25 to 30. Similarly, the waveguides 31 and 32 of the directional coupler 1A illustrated in FIG. 3 may be extended in both directions by using the post arrays 25 to 30.

Fifth Embodiment

Figure 6:
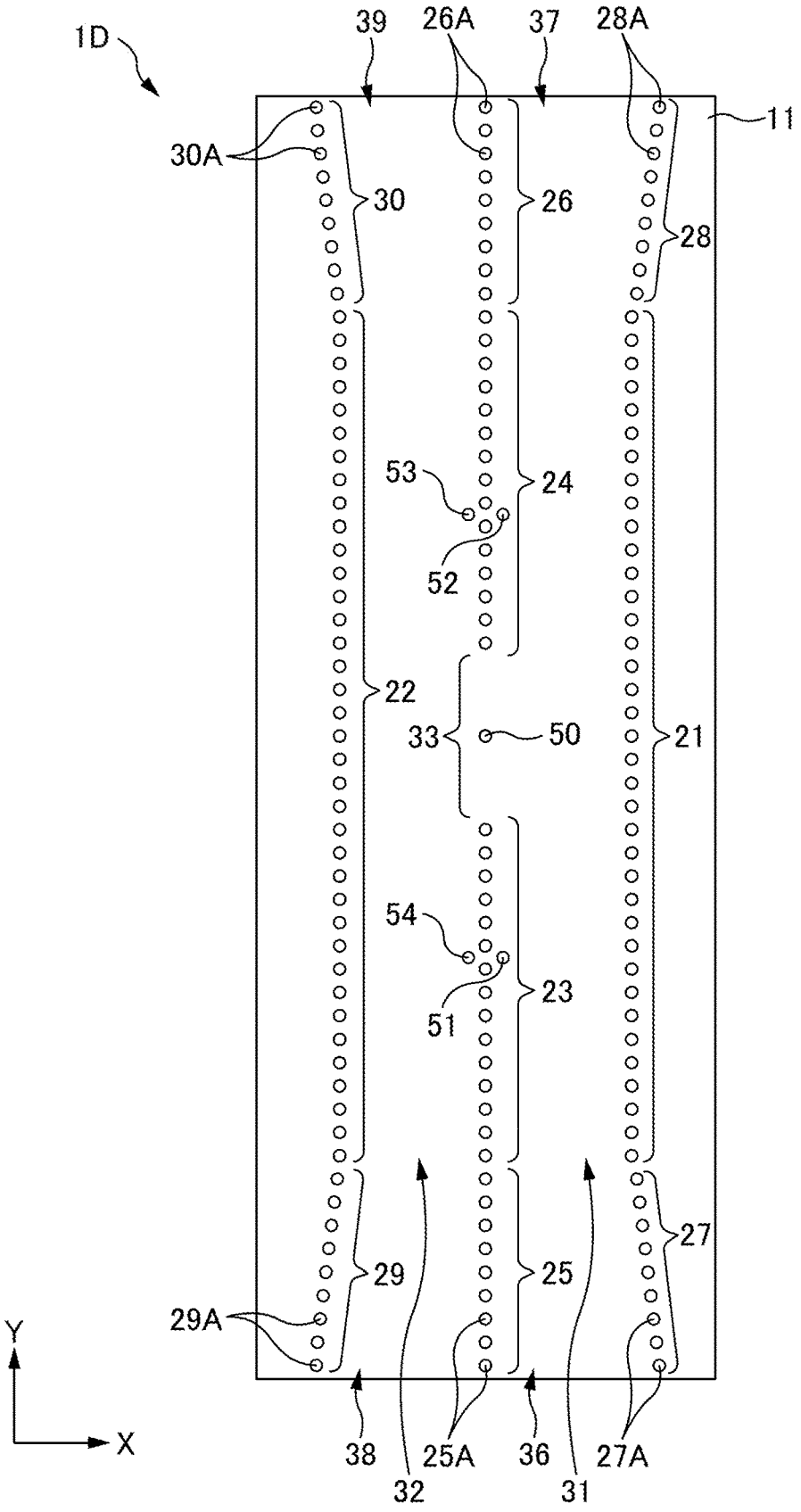
FIG. 6 is a cross-sectional view of a directional coupler according to a fifth embodiment.

FIG. 6 is a cross-sectional view of a directional coupler 1D at a section parallel to both faces of a dielectric substrate 11.

The directional coupler 1D illustrated in FIG. 6 is formed, similarly to the directional coupler 1C illustrated in FIG. 5, by extending the waveguides 31 and 32 of the directional coupler 1 illustrated in FIG. 1, in both directions by using post arrays 25 to 30. The post arrays 25 to 30 and waveguides 36 to 39 of the directional coupler 1D illustrated in FIG. 6 are configured similarly to the post arrays 25 to 30 and the waveguides 36 to 39 of the directional coupler 1C illustrated in FIG. 5. Hence, detailed descriptions of the post arrays 25 to 30 and waveguides 36 to 39 of the directional coupler 1D illustrated in FIG. 6 are omitted.

Moreover, the directional coupler 1D illustrated in FIG. 6 is formed, similarly to the directional coupler 1A illustrated in FIG. 3, by adding additional conductive posts 51 to 54 to the directional coupler 1C illustrated in FIG. 5. Although the additional conductive posts 55 and 56 are provided to the directional coupler 1A illustrated in FIG. 3, the additional conductive posts 55 and 56 are not provided to the directional coupler 1D illustrated in FIG. 6. Positions of the additional conductive posts 51 to 54 of the directional coupler 1D illustrated in FIG. 6 are the same as the positions of the additional conductive posts 51 to 54 of the directional coupler 1A illustrated in FIG. 3, respectively.

The additional conductive posts 51 to 54 of the directional coupler 1D illustrated in FIG. 6 are metalized blind via-holes. Specifically, the additional conductive posts 51 to 54 project from a second conductive layer (corresponding to the second conductive layer 13 illustrated in FIG. 3; hereinafter the same applies) toward a first conductive layer (corresponding to the first conductive layer 12 illustrated in FIG. 3; hereinafter the same applies) without reaching the first conductive layer. Hence, there exists a space between each of the additional conductive posts 51 to 54 and the first conductive layer. This brings the additional conductive posts 51 to 54 into direct electrical connection with the second conductive layer while not bringing the additional conductive posts 51 to 54 into direct electrical connection with the first conductive layer.

Sixth Embodiment

Figure 7:
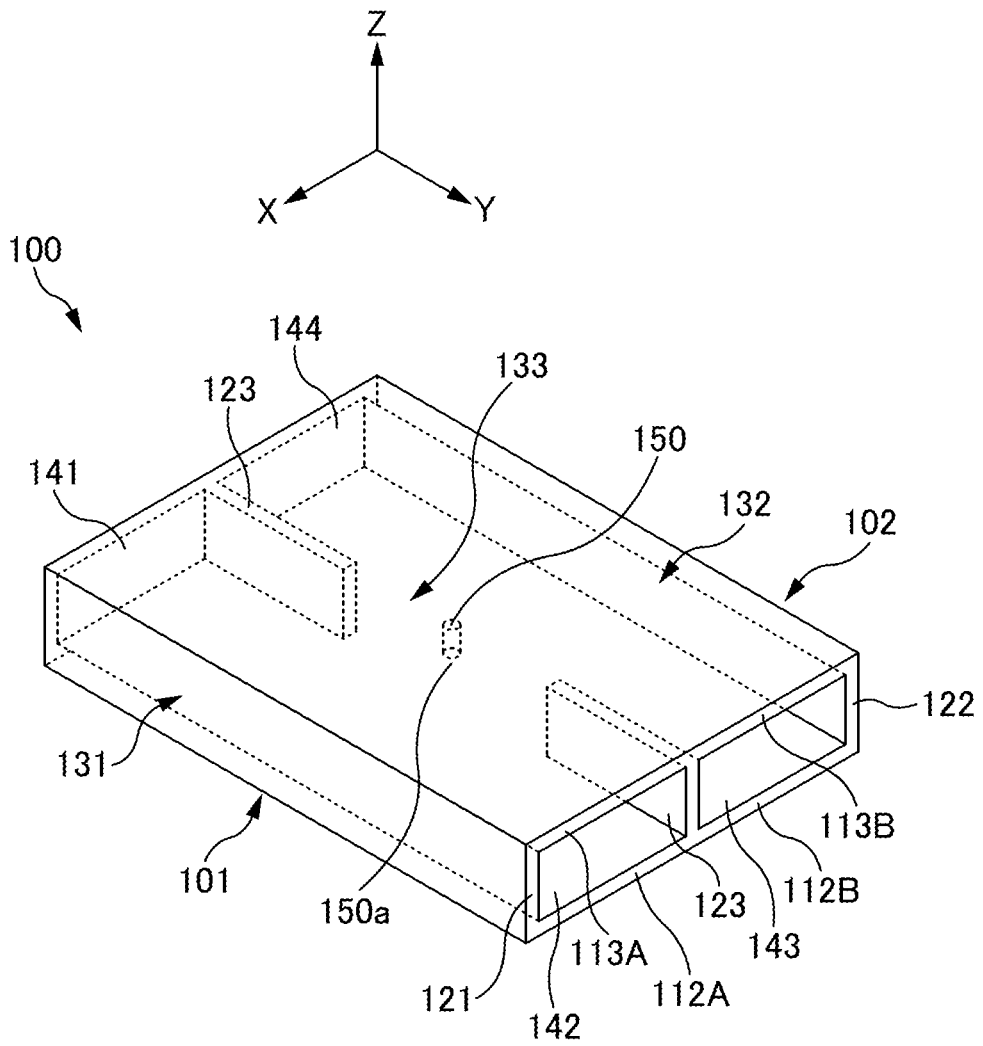
FIG. 7 is a perspective view of a directional coupler according to a sixth embodiment.

FIG. 7 is a perspective view of a directional coupler 100. In FIG. 7, a width direction of rectangular waveguides 101 and 102 of the directional coupler 100 is parallel to the X axis, a length direction of the rectangular waveguides 101 and 102 is parallel to the Y axis, and a height direction of the rectangular waveguides 101 and 102 is parallel to the Z axis.

The rectangular waveguides 101 and 102 are made of conductive material.

The rectangular waveguides 101 and 102 are equal in width, height, and length, and the width of the rectangular waveguides 101 and 102 is greater than the height of the rectangular waveguides 101 and 102. The rectangular waveguides 101 and 102 are integrally arranged in parallel in the width direction, and ends of the rectangular waveguides 101 and 102 on each of both sides are aligned.

The rectangular waveguides 101 and 102 share a narrow wall 123 located therebetween, and an inner area of the rectangular waveguide 101 and an inner area of the rectangular waveguide 102 are separated by the narrow wall 123. Since the waveguides 101 and 102 are rectangular, the narrow wall 123 is in parallel to a narrow wall 121 of the rectangular waveguide 101 and a narrow wall 122 of the rectangular waveguide 102 to face the narrow walls 121 and 122. Paired wide walls 112A and 113A of the rectangular waveguide 101 are in parallel to each other to face each other, and paired wide walls 112B and 113B of the rectangular waveguide 102 are in parallel to each other to face each other. The wide wall 112A of the rectangular waveguide 101 and the wide wall 112B of the rectangular waveguide 102 are integrally flush with each other. This applies similarly to the wide wall 113A of the rectangular waveguide 101 and the wide wall 113B of the rectangular waveguide 102.

Note that the wide walls 112A, 113A, 112B, and 113B are parallel to an XY plane, and the narrow walls 121 to 123 are parallel to a YZ plane.

The inner areas of the rectangular waveguides 101 and 102 are formed of a gaseous or solid dielectric or formed of air.

The inner area of the rectangular waveguide 101 is a first waveguide 131 for propagating electromagnetic waves, and also the inner area of the rectangular waveguide 102 is a second waveguide 132.

A rectangular coupling window 133 is formed as an opening in the center of the narrow wall 123 shared by the rectangular waveguides 101 and 102, and the first waveguide 131 and the second waveguide 132 communicate with each other through the coupling window 133. The coupling window 133 is formed of the same dielectric or air as the dielectric or air forming the first waveguide 131 and the second waveguide 132.

The height of the coupling window 133 is equal to the height of the narrow wall 123. The distance from the ends of the rectangular waveguides 101 and 102 to the coupling window 133 is equal to the distance from the other ends of the rectangular waveguides 101 and 102 to the coupling window 133.

A projecting conductor 150 is arranged in the coupling window 133. The projecting conductor 150 projects so as to extend from a boundary between the wide wall 113A of the rectangular waveguide 101 and the wide wall 113B of the rectangular waveguide 102 toward a boundary between the wide wall 112A of the rectangular waveguide 101 and the wide wall 112B of the rectangular waveguide 102. A space 150*a* exists between a tip of the projecting conductor 150 and a boundary of the wide walls 112A and 112B of the rectangular waveguides 101 and 102.

The projecting conductor 150 is arranged at the midpoint between an edge of the coupling window 133 on the negative-direction side in the Y axis and an edge of the coupling window 133 on the positive-direction side in the Y-axis.

A correspondence relationship between the directional coupler 100 illustrated in FIG. 7 and the directional coupler 1 illustrated in FIG. 1 and FIG. 2 is as presented in the following table.

TABLE 1

| | |
|---|---|
| Directional coupler 100 | Directional coupler 1 |
| Wide walls 112A, 112B | Conductive layer 12 |
| Wide walls 113A, 113B | Conductive layer 13 |
| Narrow wall 121 | Post array 21 |
| Narrow wall 122 | Post array 22 |
| Narrow wall 123 | Post arrays 23 and 24 |
| Dielectric or air forming rectangular waveguides 101 and 102 and coupling window 133 | Dielectric substrate 11 |
| Coupling window 133 | Coupling window 33 |
| Projecting conductor 150 | Projecting conductor 50 |
| First waveguide 131 | First waveguide 31 |
| Second waveguide 132 | Second waveguide 32 |
| One end 141, first port 141, of first waveguide 131 | First port 41 |
| Other end 142, second port 142, of first waveguide 131 | Second port 42 |
| One end 144, fourth port 144, of second waveguide 132 | Fourth port 44 |
| Other end 143, third port 143, of second waveguide 132 | Third port 43 |

The directional coupler 100 illustrated in FIG. 7 has a function equivalent to that of the directional coupler 1 illustrated in FIG. 1 and FIG. 2. The directional coupler 100 has high isolation performance and a high degree of coupling similarly to the directional coupler 1 illustrated in FIG. 1 and FIG. 2.

Seventh Embodiment

Figure 8:
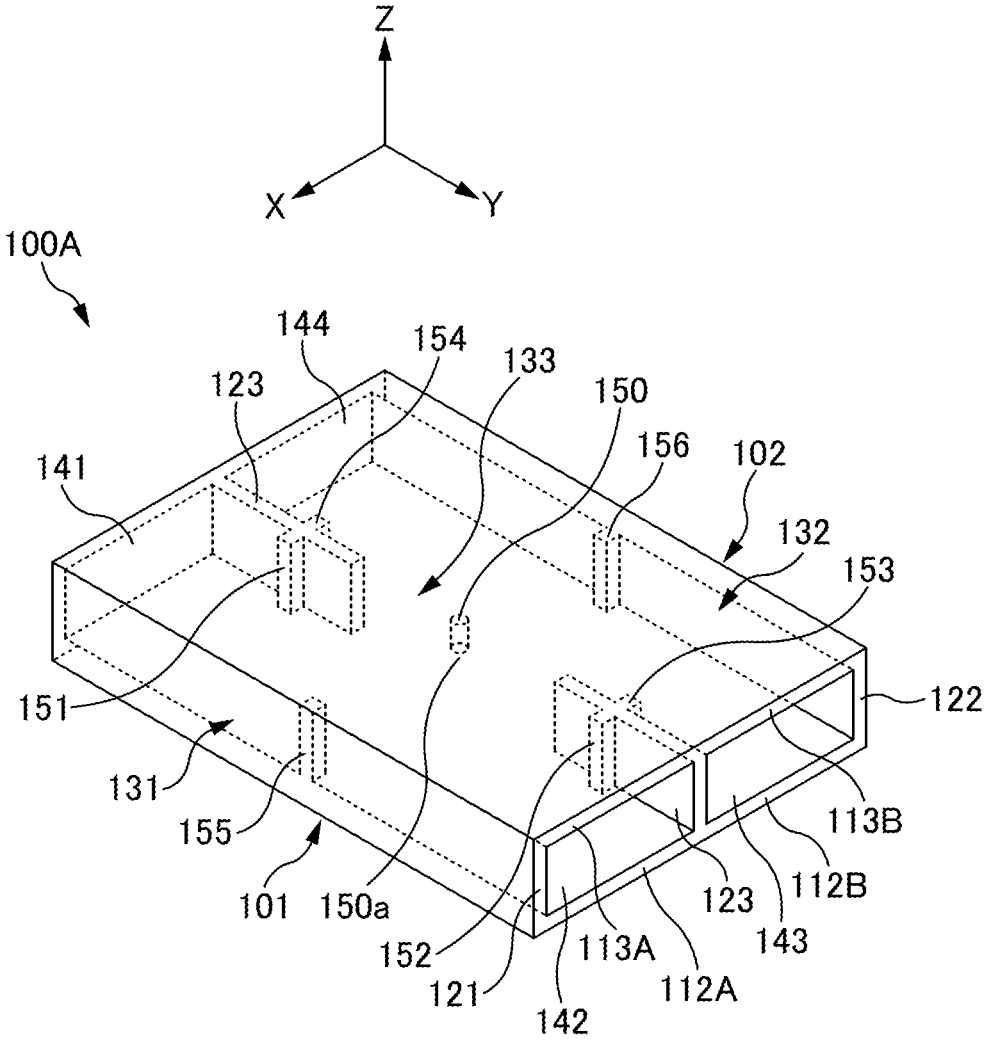
FIG. 8 is a perspective view of a waveguide device using a directional coupler according to a seventh embodiment.

FIG. 8 is a perspective view of a directional coupler 100A. The directional coupler 100A is formed by adding conductive projections 151 to 156 to the directional coupler 100 illustrated in FIG. 7.

The conductive projections (first projections) 151 and 152 project from a narrow wall 123 toward a first waveguide 131. The conductive projection 151 is arranged closer to a first port 141 of the first waveguide 131 than the coupling window 133, and the conductive projection 152 is arranged closer to a second port 142 of the first waveguide 131 than the coupling window 133. The distance from the conductive projection 151 to the coupling window 133 is equal to the distance from the conductive projection 152 to the coupling window 133. In other words, the conductive projection 151 and the conductive projection 152 are arranged at positions plane-symmetric with respect to a symmetry plane (XZ plane) orthogonal to the narrow wall 123 and passing through the center of the coupling window 133.

The conductive projections (second projections) 153 and 154 project from the narrow wall 123 toward a second waveguide 132. The conductive projection 154 is arranged closer to a fourth port 144 of the second waveguide 132 than the coupling window 133, and the conductive projection 153 is arranged closer to a third port 143 of the second waveguide 132 than the coupling window 133. The distance from the conductive projection 154 to the coupling window 133 is equal to the distance from the conductive projection 153 to the coupling window 133. In other words, the conductive projection 153 and the conductive projection 154 are arranged at positions plane-symmetric with respect to a symmetry plane (XZ plane) orthogonal to the narrow wall 123 and passing through the center of the coupling window 133.

The conductive projection 151 and the conductive projection 154 are arranged at positions plane-symmetric with respect to the narrow wall 123 parallel to the YZ plane. The conductive projection 152 and the conductive projection 153 are also arranged at positions plane-symmetric with respect to the narrow wall 123.

Here, the conductive projections 151 to 154 of the directional coupler 100A correspond to the additional conductive posts 51 to 54 of the directional coupler 1A illustrated in FIG. 3, respectively. Hence, as in the directional coupler 1A, the conductive projections 151 to 154 are formed to lower an input reflection coefficient and a separation factor in a frequency band to be used by the directional coupler 100A.

The conductive projection (first central projection) 155 projects from a position facing the projecting conductor 150 in the narrow wall 121 toward the inside of the first waveguide 131. The conductive projection (second central projection) 156 projects from a position facing the projecting conductor 150 in the narrow wall 122 toward the inside of the second waveguide 132. The conductive projections 155 and 156 are arranged on a plane orthogonal to the narrow wall 123 and passing through the center of the coupling window 133. In other words, the conductive projections 155 and 156 are arranged to face each other with the center of the coupling window 133 therebetween.

At the midpoint between the conductive projection 155 and the conductive projection 156, the projecting conductor 150 is arranged.

Here, the conductive projections 155 and 156 of the directional coupler 100A correspond to the additional conductive posts 55 and 56 of the directional coupler 1A illustrated in FIG. 3, respectively. Hence, as in the directional coupler 1A, the conductive projections 155 and 156 are formed to lower an input reflection coefficient in a frequency band to be used by the directional coupler 100A.

The conductive projections 151, 152, and 155 extend from the wide wall 113A to the wide wall 112A and are electrically connected to the wide wall 113A and the wide wall 112A. Similarly, the conductive projections 153, 154, and 156 extend from the wide wall 113B to the wide wall 112B and are electrically connected to the wide wall 113B and the wide wall 112B.

Note that the conductive projections 151, 152, and 155 may not necessarily reach the wide wall 112A. In this case, a space exists between each of the conductive projections 151, 152, and 155 and the wide wall 112A. Similarly, the conductive projections 153, 154, and 156 may not necessarily reach the wide wall 112B, and a space may exist between each of the conductive projections 153, 154, and 156 and the wide wall 112B.

Eighth Embodiment

Figure 9:
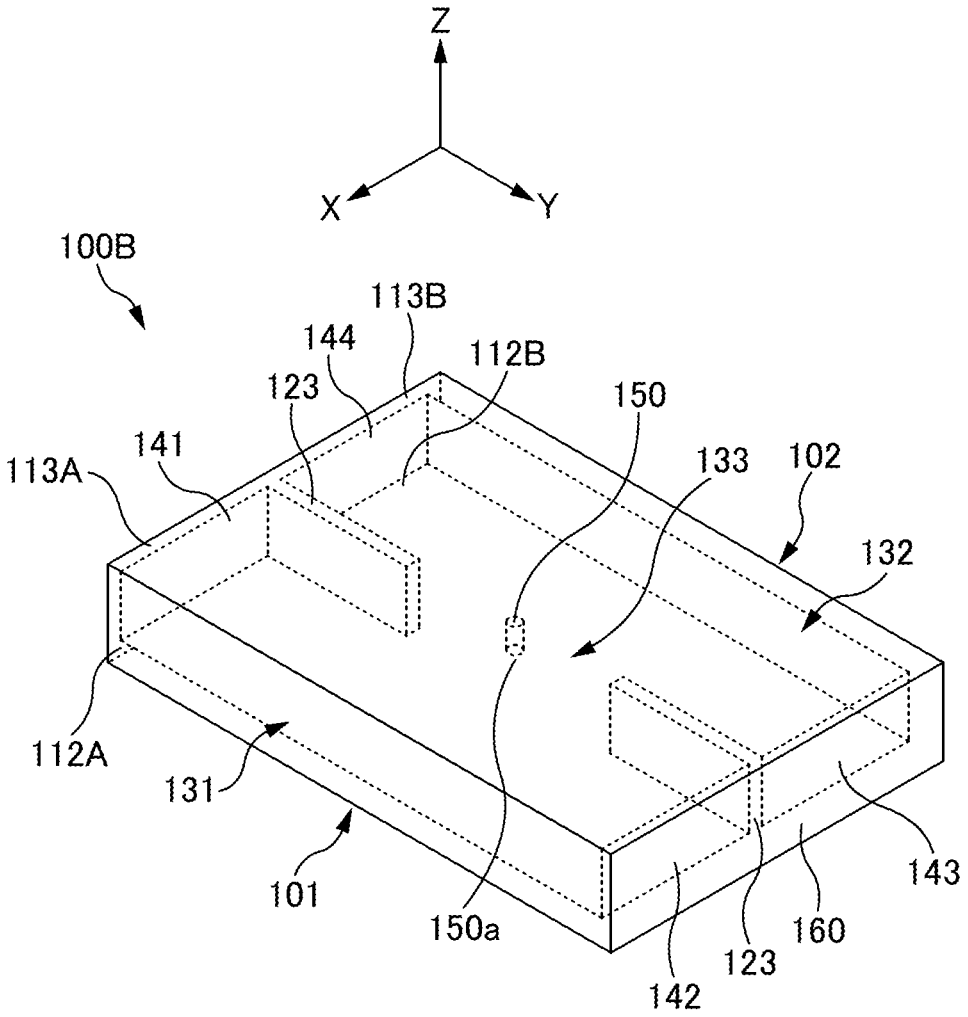
FIG. 9 is a perspective view of a waveguide device according to an eighth embodiment.

FIG. 9 is a perspective view of a waveguide device 100B.

The waveguide device 100B is formed by short-circuiting the ports 142 and 143 on the same side of the waveguides 131 and 132 of the directional coupler 100.

Specifically, the ends of rectangular waveguides 101 and 102 are closed by a conductive short-circuit wall 160, and ports 142 and 143 of the waveguides 131 and 132 are short-circuited by the short-circuit wall 160. The ends of rectangular waveguides 101 and 102 correspond to the ports 142 and 143 of the waveguides 131 and 132.

Here, the short-circuit wall 160 of the waveguide device 100B corresponds to the arrays of the conductive posts 61 and 62 of the waveguide device 1B illustrated in FIG. 4. Hence, the waveguide device 100B has a function equivalent to that of the waveguide device 1B illustrated in FIG. 4.

The ports 142 and 143 of the waveguides 131 and 132 of the directional coupler 100 illustrated in FIG. 8 may be short-circuited, as the ports 142 and 143 of the waveguides 131 and 132 of the directional coupler 100 illustrated in FIG. 7 are short-circuited.

Ninth Embodiment

Figure 10:
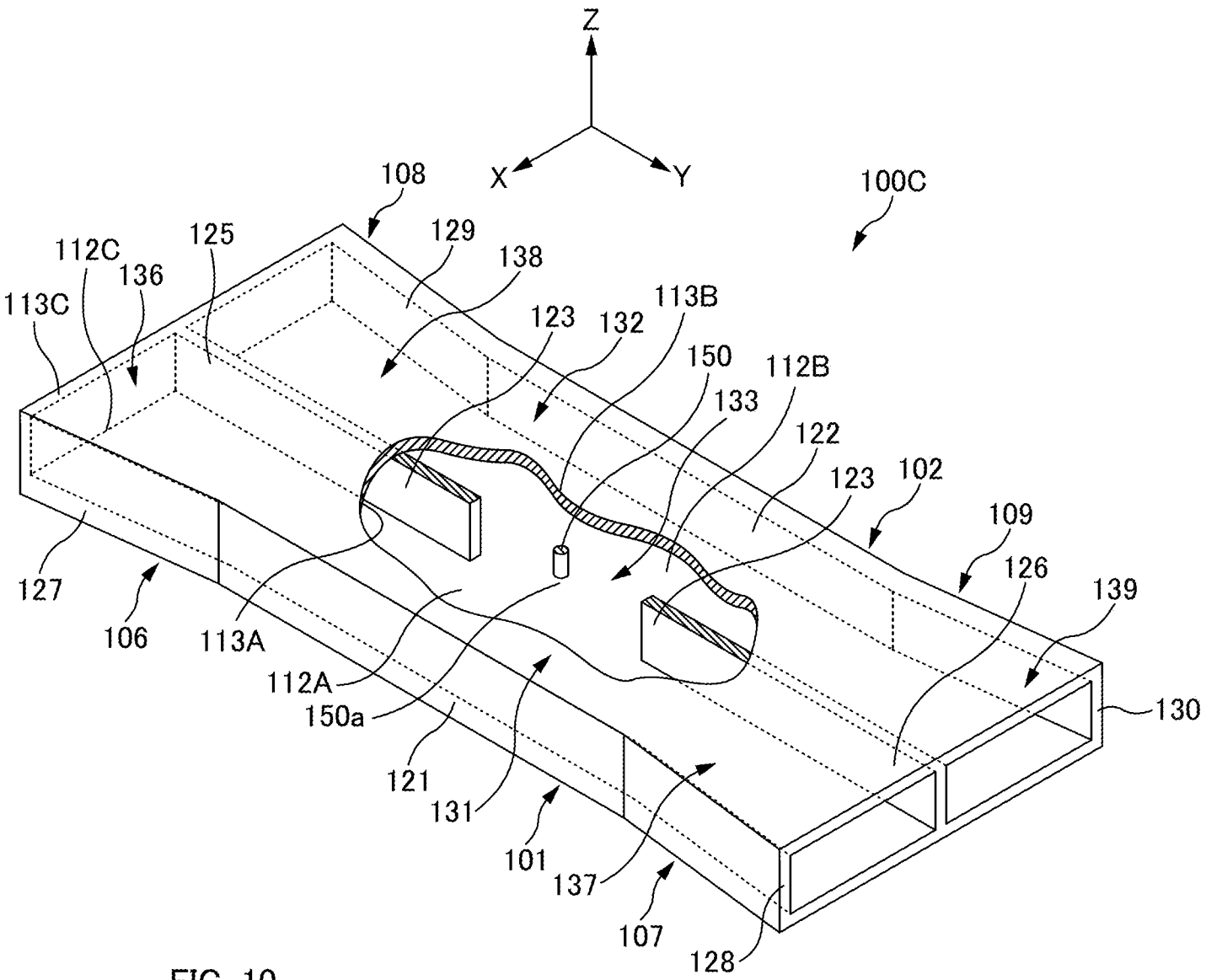
FIG. 10 is a perspective view of a directional coupler according to a ninth embodiment.

FIG. 10 is a perspective view of a directional coupler 100C. In FIG. 10, wide walls 113A and 113B are illustrated in a cutaway manner so that the inside of the directional coupler 100C will be more visible.

The directional coupler 100C is formed by extending the waveguides 131 and 132 in both directions by coupling tapered rectangular waveguides 106 to 109, which are increased in width toward the ends, to both the ends of the rectangular waveguides 101 and 102 of the directional coupler 100. Description is specifically given below.

The tapered rectangular waveguides 106 to 109 are made of conductive material.

The tapered rectangular waveguides 106 and 108 are integrally arranged in parallel in the width direction, the tapered rectangular waveguides 106 and 108 share a narrow wall 125 located therebetween, such that an inner area of the tapered rectangular waveguide 106 and an inner area of the tapered rectangular waveguide 108 are separated by the narrow wall 125. Similarly, the tapered rectangular waveguides 107 and 109 are arranged in parallel in the width direction, and an inner area of the tapered rectangular waveguide 107 and an inner area of the tapered rectangular waveguide 109 are separated by the narrow wall 126 shared by the tapered rectangular waveguides 107 and 109.

The inner area of the tapered rectangular waveguide 106 is a waveguide 136 for propagating electromagnetic waves. Similarly, the inner areas of the tapered rectangular waveguides 107 to 109 are waveguides 137 to 139, respectively.

The tapered rectangular waveguide 106 is coupled with one end of the rectangular waveguide 101, and the waveguide 136 in the tapered rectangular waveguide 106 is electromagnetically coupled with the first waveguide 131 in the rectangular waveguide 101. Here, the waveguide 136 is formed of the same dielectric or air as the dielectric or air forming the first waveguide 131.

The narrow wall 125 shared by the tapered rectangular waveguides 106 and 108 is integrally flush with narrow walls 123 of the rectangular waveguides 101 and 102. The narrow wall 127 of the tapered rectangular waveguide 106 is coupled to thereby be integrated with the narrow wall 121 of the rectangular waveguide 101. The narrow wall 127 is inclined with respect to the narrow wall 121, and the interval between the narrow wall 127 and the narrow wall 125 gradually increases as the distance from the rectangular waveguide 101. Paired wide walls 112C and 113C of the tapered rectangular waveguide 106 are in parallel with each other. The one wide wall 112C is integrally flush with the wide wall 112A of the rectangular waveguide 101, and the other wide wall 113C is integrally flush with the wide wall 113A of the rectangular waveguide 101.

As the tapered rectangular waveguide 106 is coupled with one end of the rectangular waveguide 101, the tapered rectangular waveguide 108 is coupled with one end of the rectangular waveguide 102. The tapered rectangular waveguide 106 and the tapered rectangular waveguide 108 have shapes plane-symmetric with respect to the shared narrow wall 125. Accordingly, the narrow wall 129 of the tapered rectangular waveguide 108 is inclined with respect to the narrow wall 122, and the interval between the narrow wall 129 and the narrow wall 125 gradually increases with distance from the rectangular waveguide 102.

As the tapered rectangular waveguide 106 is coupled with one end of the rectangular waveguide 101, the tapered rectangular waveguide 107 is coupled with the other end of the rectangular waveguide 101. The tapered rectangular waveguide 106 and the tapered rectangular waveguide 107 have shapes plane-symmetric with respect to a symmetry plane (XZ plane) orthogonal to the narrow wall 123 and passing through the center of the coupling window 133. Accordingly, the narrow wall 128 of the tapered rectangular waveguide 107 is inclined with respect to the narrow wall 121, and the interval between the narrow wall 128 and the narrow wall 126 gradually increases with distance from the rectangular waveguide 101.

As the tapered rectangular waveguide 108 is coupled with the one end of the rectangular waveguide 102, the tapered rectangular waveguide 109 is coupled with the other end of the rectangular waveguide 102. The tapered rectangular waveguide 109 and the tapered rectangular waveguide 108 have shapes plane-symmetric with respect to a symmetry plane (XZ plane) orthogonal to the narrow wall 123 and passing through the center of the coupling window 133. Accordingly, the narrow wall 130 of the tapered rectangular waveguide 109 is inclined with respect to the narrow wall 122, and the interval between the narrow wall 130 and the narrow wall 126 gradually increases with distance from the rectangular waveguide 102.

The waveguides 136 to 139 of the tapered rectangular waveguides 106 to 109 are formed of the same dielectric or air as the dielectric or air forming the waveguides 131 and 132.

The waveguides 136 to 139 of the directional coupler 100C illustrated in FIG. 10 correspond to the waveguides 36 to 39 of the directional coupler 1C illustrated in FIG. 5, respectively. Hence, the directional coupler 100C illustrated in FIG. 10 has a function equivalent to that of the directional coupler 1C illustrated in FIG. 5.

Note that FIG. 10 is obtained such that the waveguides 131 and 132 of the directional coupler 100 illustrated in FIG. 7 are extended in both directions using the tapered rectangular waveguides 106 to 109. Similarly, the waveguides 131 and 132 of the directional coupler 100A illustrated in FIG. 8 may be extended in both directions using the tapered rectangular waveguides 106 to 109.

Tenth Embodiment

Figure 11:
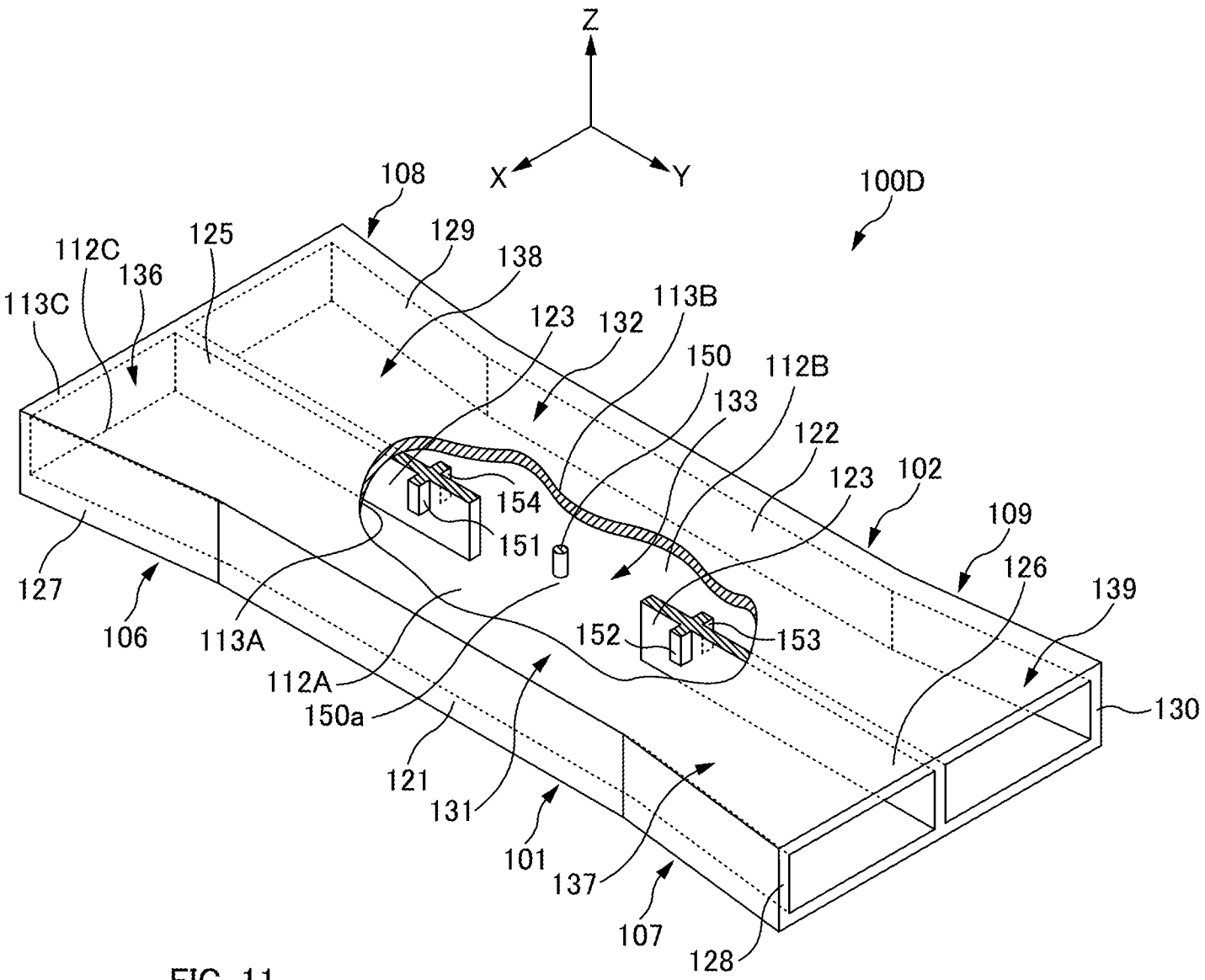
FIG. 11 is a perspective view of a directional coupler according to a tenth embodiment.

FIG. 11 is a perspective view of a directional coupler 100D. In FIG. 11, wide walls 113A and 113B are illustrated in a cutaway manner so that the inside of the directional coupler 100D will be more visible.

The directional coupler 100D illustrated in FIG. 11 is formed, similarly to the directional coupler 100C illustrated in FIG. 10, by extending the waveguides 131 and 132 in both directions by coupling tapered rectangular waveguides 106 to 109, which are increased in width toward the ends, to both the ends of the rectangular waveguides 101 and 102 of the directional coupler 100 (refer to FIG. 7). The tapered rectangular waveguides 106 to 109 in the directional coupler 100D illustrated in FIG. 11 are configured similarly to the tapered rectangular waveguides 106 to 109 in the directional coupler 100C illustrated in FIG. 10. Hence, detailed descriptions of the tapered rectangular waveguides 106 to 109 of the directional coupler 100D illustrated in FIG. 11 are omitted.

Moreover, the directional coupler 100D illustrated in FIG. 11 is formed, similarly to the directional coupler 100A illustrated in FIG. 8, by adding conductive projections 151 to 154 to the directional coupler 100C illustrated in FIG. 10. Although the conductive projections 155 and 156 are provided to the directional coupler 100A illustrated in FIG. 8, the conductive projections 155 and 156 are not provided to the directional coupler 100D illustrated in FIG. 11. Positions of the conductive projections 151 to 154 of the directional coupler 100D illustrated in FIG. 11 are the same as the positions of the conductive projections 151 to 154 of the directional coupler 100A illustrated in FIG. 8, respectively.

The conductive projections 151 and 152 of the directional coupler 100D illustrated in FIG. 11 extend from the wide wall 113A toward the wide wall 112A without reaching the wide wall 112A. Hence, a space exists between each of the conductive projections 151 and 152 and the wide wall 112A. Similarly, the conductive projections 153 and 154 extend from the wide wall 113B toward the wide wall 112B without reaching the wide wall 112B, and hence a space exists between each of the conductive projections 153 and 154 and the wide wall 112B.

The directional coupler 100D illustrated in FIG. 11 has a function equivalent to that of the directional coupler 1D illustrated in FIG. 6.

Eleventh Embodiment

Figure 12:
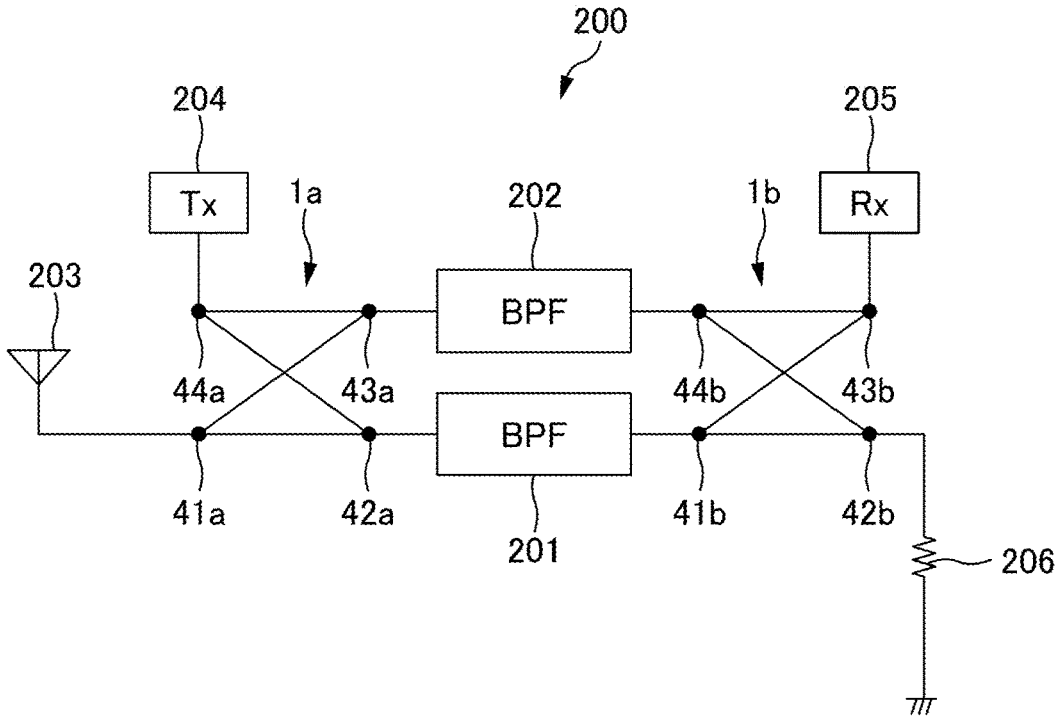
FIG. 12 is a block diagram of a diplexer.

A diplexer using two directional couplers 1 is described. FIG. 12 is a block diagram of a diplexer 200. In FIG. 12, one of the two directional couplers 1 is denoted by a reference sign "1*a*", and the other of the directional couplers 1 is denoted by a reference sign "1*b*". The ports 41 to 44 of the one directional coupler 1*a* are denoted by reference signs "41*a* to 44*a*", and the ports 41 to 44 of the other directional coupler 1*b* are denoted by reference signs "41*b* to 44*b*".

The diplexer 200 includes the directional coupler 1*a*, the directional coupler 1*b*, a first band-pass filter 201, and a second band-pass filter 202.

The first port 41*a* of the directional coupler 1*a* is connected to an antenna 203, the second port 42*a* is connected to the first band-pass filter 201, and the third port 43*a* is connected to the second band-pass filter 202, and the fourth port 44*a* is connected to a transmission circuit 204.

The first port 41*b* of the directional coupler 1*b* is connected to the first band-pass filter 201, the second port 42*b* is grounded via a resistor 206, the third port 43*b* is connected to a reception circuit 205, and the fourth port 44*b* is connected to the second band-pass filter 202.

Each of the first band-pass filter 201 and the second band-pass filter 202 is a band-pass filter (BPF) that allows a high-frequency signal of a predetermined frequency band to pass therethrough and reflects signals out of the band. Specifically, the frequency band of a signal received by the reception circuit 205 is set within pass-bands of the first band-pass filter 201 and the second band-pass filter 202, and the frequency band of a signal transmitted from the transmission circuit 204 is set out of the pass-bands of the first band-pass filter 201 and the second band-pass filter 202. Note that the frequency band of a signal transmitted from the transmission circuit 204 is set within bands to be used by the directional couplers 1*a* and 1*b*.

A high-frequency signal generated by the transmission circuit 204 is input to the fourth port 44*a* of the directional coupler 1*a* and then transmitted from the antenna 203 via two paths. Specifically, regarding one of the paths, the high-frequency signal input to the fourth port 44*a* is transmitted from the fourth port 44*a* to the third port 43*a*, reflected at a boundary face between the third port 43*a* and the second band-pass filter 202, and thereafter transmitted to the first port 41*a*. Regarding the other path, the high-frequency signal input to the fourth port 44*a* is transmitted from the fourth port 44*a* to the second port 42*a*, reflected at a boundary face between the second port 42*a* and the first band-pass filter 201, and thereafter transmitted to the first port 41*a*.

A high-frequency signal received by the antenna 203 is input to the first port 41*a* of the directional coupler 1*a* and then transmitted, via two paths, to the reception circuit 205.

Specifically, regarding one of the paths, the high-frequency signal input to the first port 41*a* is transmitted from the first port 41*a* to the third port 43*a*, input, after passing through the second band-pass filter 202, to the fourth port 44*b* of the directional coupler 1*b*, and then transmitted to the third port 43*b*. Regarding the other path, the high-frequency signal input to the first port 41*a* is transmitted from the first port 41*a* to the second port 42*a*, input, after passing through the first band-pass filter 201, to the first port 41*b* of the directional coupler 1*b*, and then transmitted to the third port 43*b*.

Hence, the above-described diplexer 200 outputs an input high-frequency signal generated by the transmission circuit 204, from the first port 41*a* of the directional coupler 1*a* but not from the ports 42*b* or 43*b* of the directional coupler 1*b*. The diplexer 200 outputs an input high-frequency signal received by the antenna 203, from the third port 43*b* of the directional coupler 1*b* but not from the port 44*a* of the directional coupler 1*a*. Hence, transmission of the reception signal to the transmission circuit 204 is prevented by the diplexer 200, and transmission of the transmission signal to the reception circuit 205 is prevented by the diplexer 200, which allows the antenna 203 to be used for both reception and transmission.

Figure 13:
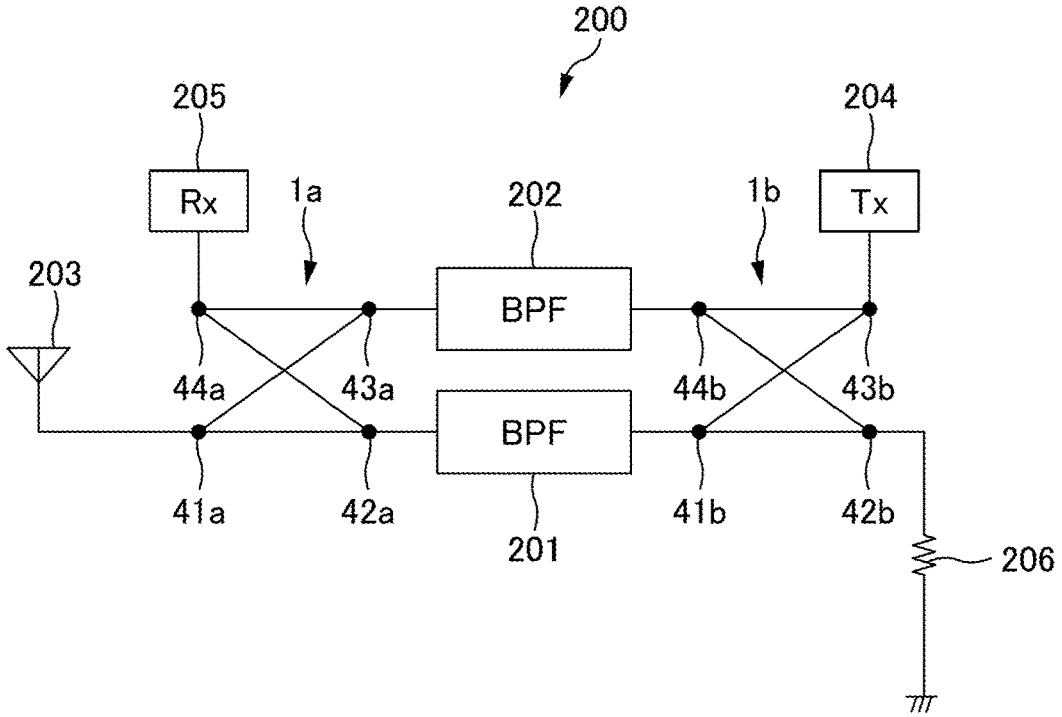
FIG. 13 is a block diagram of the diplexer.

Note that, as illustrated in FIG. 13, the transmission circuit 204 and the reception circuit 205 may be switched, the reception circuit 205 may be connected to the fourth port 44*a* of the directional coupler 1*a*, and the transmission circuit 204 may be connected to the third port 43*b* of the directional coupler 1*b*. In this case, the frequency band of a signal transmitted from the transmission circuit 204 is set in the pass-bands of the first band-pass filter 201 and the second band-pass filter 202, and the frequency band of a signal received by the reception circuit 205 is set to a band different from the pass-bands of the first band-pass filter 201 and the second band-pass filter 202.

Each of the directional couplers 1*a* and 1*b* of the diplexer 200 illustrated in FIG. 12 and FIG. 13 may be changed into the directional coupler 1A (refer to FIG. 3), the directional coupler 1C (refer to FIG. 5), the directional coupler 1D (refer to FIG. 6), the directional coupler 100 (refer to FIG. 7), the directional coupler 100A (refer to FIG. 8), the directional coupler 100C (refer to FIG. 10), or the directional coupler 100D (refer to FIG. 11) described above.

<Verification 1>

A simulation was performed to verify below that provision of the projecting conductor 150 in the coupling window 133, as in the directional coupler 100 (refer to FIG. 7) and the directional coupler 100D (refer to FIG. 11), lowers the separation factors and the input reflection coefficients of the directional couplers 100 and 100D and heightens the degrees of coupling of the directional couplers 100 and 100D.

Conditions for the simulation are as presented in Table 2. Note that, since the function of the directional coupler (refer to FIG. 1 and FIG. 2) and the function of the directional coupler 100 are equivalent to each other, conditions of the directional coupler 1 corresponding to the directional coupler 100 are presented in parentheses. This applies similarly to conditions of the directional coupler 1D corresponding to the directional coupler 100D.

TABLE 2

| Material forming inner areas of rectangular waveguides 101 and 102 (material of dielectric substrate 11) | Quartz glass |
|---|---|
| Height of waveguides 131 and 132<br>(Thickness of dielectric substrate 11)<br>(Height of conductive posts 23A and 24A) | 500 μm |
| Width of waveguides 131 and 132<br>(Interval from post array 21 to post arrays 23 and 24)<br>(Interval from post array 22 to post arrays 23 and 24) | 1220 μm |
| Thickness of narrow wall 123<br>(Diameter of conductive posts 23A and 24A) | 100 μm |
| Height of coupling window 133<br>(Height of coupling window 33) | 500 μm |
| Width of coupling window 133<br>(Distance from end of post array 23 to beginning of post array 24)<br>(Width of coupling window 33) | 1740 μm |
| Projecting distance from wide walls 113A and 113B to tip of projecting conductor 150<br>(Projecting distance from conductive layer 113 to tip of projecting conductor 50)<br>(In case that projecting conductor 50 is blind via, depth of blind via) | 200 μm |
| Diameter of projecting conductor 150<br>(Diameter of projecting conductor 50) | 100 μm |
| Projecting distance of conductive projections 151 to 154 from narrow wall 123<br>(Diameter of additional conductive posts 51 to 54) | 200 to 300 μm |
| Height of conductive projections 151 to 154<br>(Height of additional conductive posts 51 to 54)<br>(In case that additional conductive posts 51 to 54 are blind vias, depth of blind vias) | 200 μm |

The input reflection coefficient at the first port 141, the insertion loss at the second port 142, and the degree of coupling at the third port 143, and the separation factor at the fourth port 144 in a case of inputting a signal to the first port 141 of the directional coupler 100 were simulated. The results are presented in the graph in FIG. 14.

Figure 15:
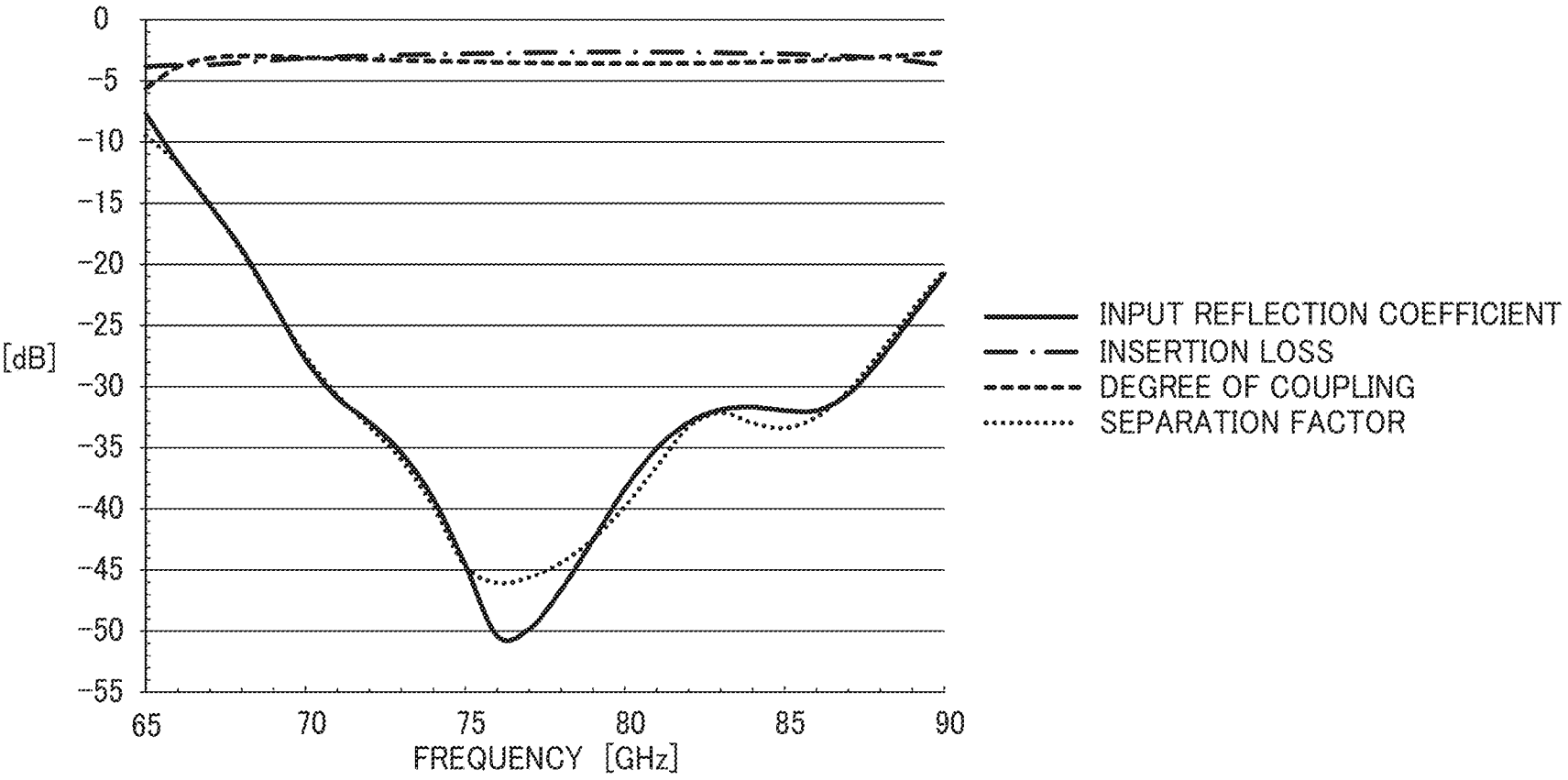
FIG. 15 is a graph illustrating frequency characteristics of the directional coupler according to the tenth embodiment.

Similarly, a simulation was performed for the directional coupler 100D, and the results are presented in FIG. 15. Note that, in the case of the directional coupler 100D, an end portion of the tapered rectangular waveguide 106 is used as an input port, an end portion of the tapered rectangular waveguide 107 is used as an output port, an end portion of the tapered rectangular waveguide 109 is used as a coupling port, and an end portion of the tapered rectangular waveguide 108 is used as an isolation port.

As a first comparative example, the input reflection coefficient at the first port 141, the insertion loss at the second port 142, the degree of coupling at the third port 143, and the separation factor at the fourth port 144 in a case of inputting a signal to the first port 141 of a directional coupler with the projecting conductor 50 and conductive projections 151 to 156 of the directional coupler 100 being omitted were simulated. The results are presented in the graph in FIG. 16. Here, other conditions of the directional coupler according to the first comparative example are similar to the conditions of the directional coupler 100 in the embodiment (refer to Table 1).

Similarly, as a second comparative example, the input reflection coefficient, the insertion loss, the degree of coupling, and the separation factor were also simulated for a directional coupler with the projecting conductor 50 of the directional coupler 100D being omitted. The results are presented in the graph in FIG. 17.

The vertical axis in each of FIGS. 14 to 17 indicates the input reflection coefficient, the insertion loss, the degree of coupling, and the separation factor, in level. The horizontal axis indicates the frequency.

Figure 14:
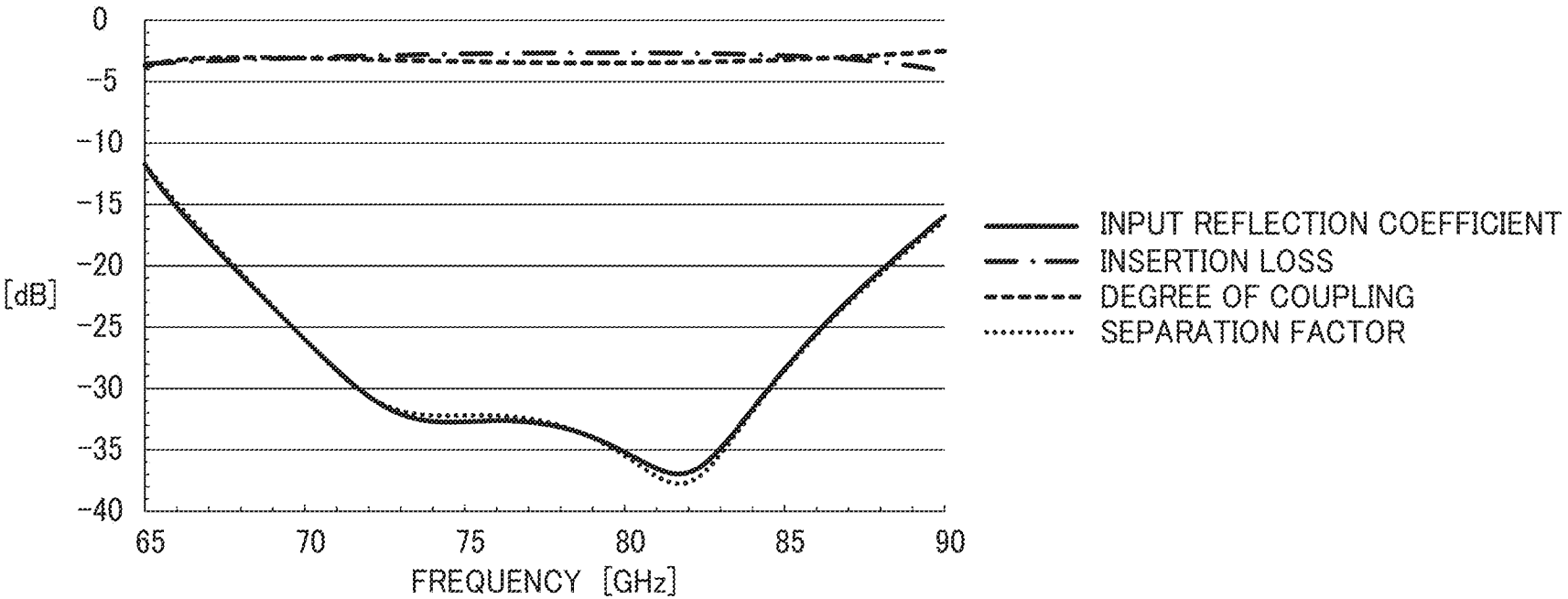
FIG. 14 is a graph illustrating frequency characteristics of the directional coupler according to the sixth embodiment.
Figure 16:
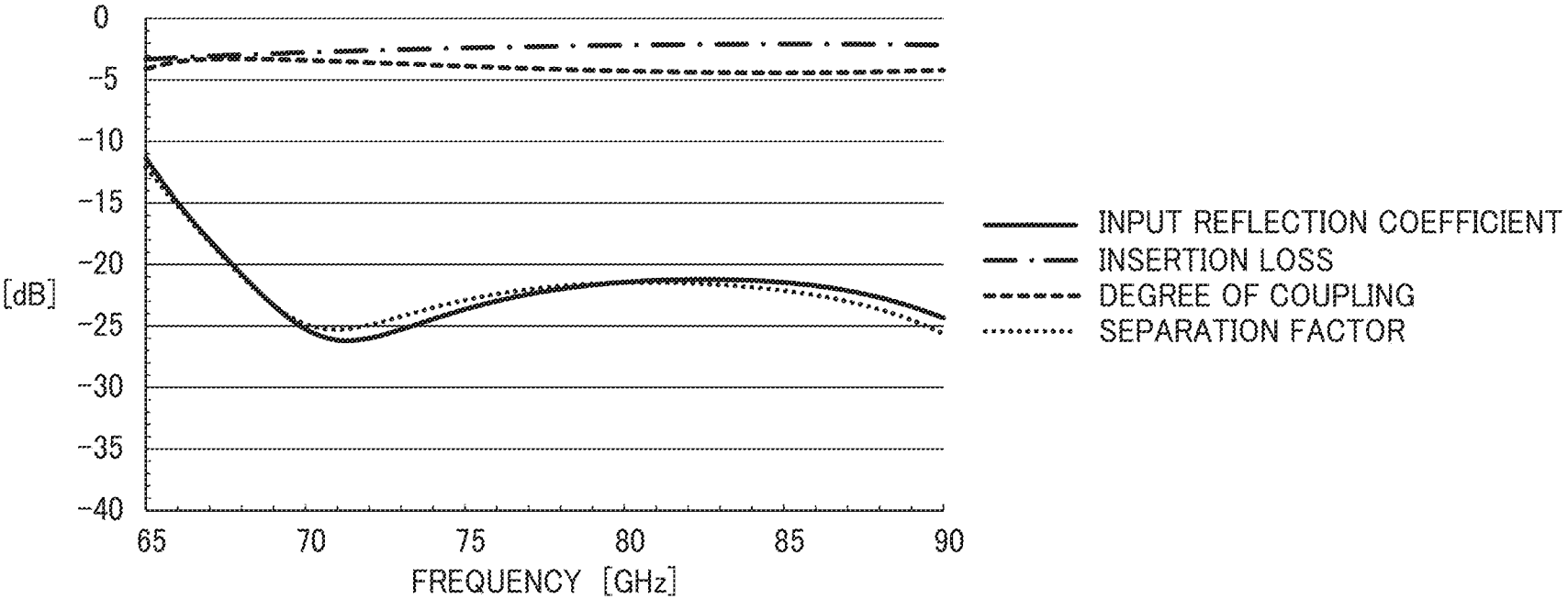
FIG. 16 is a graph illustrating frequency characteristics of a directional coupler according to a first comparative example with no projecting conductor being provided.

By comparing FIGS. 14 to 16, it can be seen that the separation factors of the directional couplers 100 and 100D of the embodiment are lower than the separation factor of the directional coupler of the first comparison example (in particular, the frequency band from 70 to 85 [GHz]). This similarly applies to the input reflection coefficient.

It can be seen that the degrees of coupling of the directional couplers 100 and 100D of the embodiment are higher than the degree of coupling of the directional coupler of the first comparison example (in particular, the frequency band from 70 to 85 [GHz]).

Hence, it can be seen that provision of the projecting conductor 150 in the coupling window 133 lowers the separation factors and the input reflection coefficients of the directional couplers 100 and 100D and heightens the degrees of coupling of the directional couplers 100 and 100D.

By comparing FIGS. 14 and 16, it can be seen that the separation factor and the input reflection coefficient of the directional coupler 100D are lower than those of the directional coupler 100. Hence, it can be seen that provision of the conductive projections 151 to 154 as in the directional coupler 100D improves performance of the directional coupler 100D.

Figure 17:
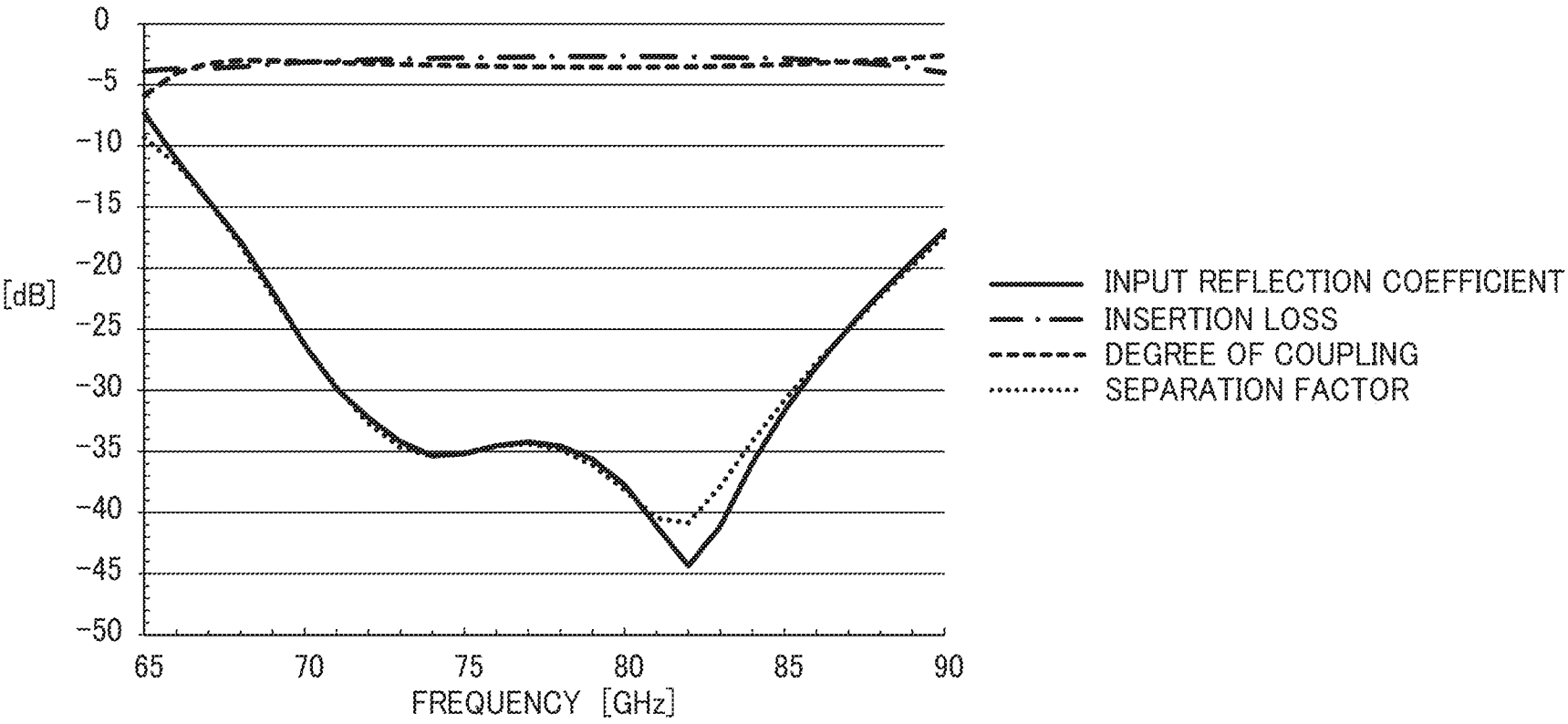
FIG. 17 is a graph illustrating frequency characteristics of a directional coupler according to a second comparative example with no projecting conductor being provided.

FIG. 15 and FIG. 17 are compared. The band in which the input reflection coefficient and the separation factor of the directional coupler 100D are −30 [dB] or lower is approximately 70 to 87 [GHz] (refer to FIG. 16). Whereas, the band in which the input reflection coefficient and the separation factor of the directional coupler of the second comparative example are −30 [dB] or lower is approximately 71 to 85 [GHz]. Hence, it can be seen that provision of the projecting conductor 150 as in the directional coupler 100D widens the band in which the input reflection coefficient and the separation factor are −30 [dB] or lower.

The input reflection coefficient and the separation factor of the directional coupler 100D are extremely smaller than those of the directional coupler of the second comparative example in the band from 76 to 77 [GHz]. Hence, it can be seen that provision of the projecting conductor 150 as in the directional coupler 100D improves input reflection characteristics and isolation performance in the band from 76 to 77 [GHz].

Here, the width of the waveguides 131 and 132 of the directional couplers 100 and 100D is 1220 [μm], and the cutoff frequency $f_c$ obtained from the width is approximately 63.1 [GHz]. Accordingly, the center frequency used by the directional couplers 100 and 100D is approximately 78.8 [GHz], which is 1.25 times as high as the cutoff frequency $f_c$. Meanwhile, the band in which the separation factor of the directional coupler 100 is −30 [dB] or lower is from 71.5 to 84.5 [GHz] (refer to FIG. 14), and the center frequency of the band is 78 [GHz]. Hence, the width of the waveguides 131 and 132 is considered to be appropriately designed in a case that the directional coupler 100 is used in the band. The band in which the separation factor of the directional coupler 100D is −30 [dB] or lower is from 71 to 87 [GHz] (refer to FIG. 15), and the center frequency of the band is approximately 79 [GHz]. Hence, the width of the waveguides 131 and 132 is considered to be appropriately designed in a case that the directional coupler 100D is used in the band.

In a case that microwaves having the center frequency (approximately 78.8 [GHz]) of the frequency band used by the directional couplers 100 or 100D enter the waveguides 131 and 132, the guide wavelength ($\lambda_g$) is 3257 [μm]. Meanwhile, since the width (1740 [μm]) of the coupling window 133 of the directional couplers 100 and 100D is designed to be a value close to 53.4% of the guide wavelength, the width is considered to be appropriately designed.

<Verification 2>

Next, in the waveguide device 100B illustrated in FIG. 9, an influence of the projecting distance from the wide walls 113A and 113B to the tip of the projecting conductor 150, on the input reflection coefficient is verified through a simulation.

Conditions for the simulation are as presented in Table 2. Note that the projecting distance from the wide walls 113A and 113B to the tip of the projecting conductor 150 was changed from 175 [μm], to 200 [μm] and then to 225 [μm].

The input reflection coefficient at the first port 141 in a case of inputting a signal to the first port 141 of the waveguide device 100B was simulated. The results are presented in the graph in FIG. 18.

Figure 18:
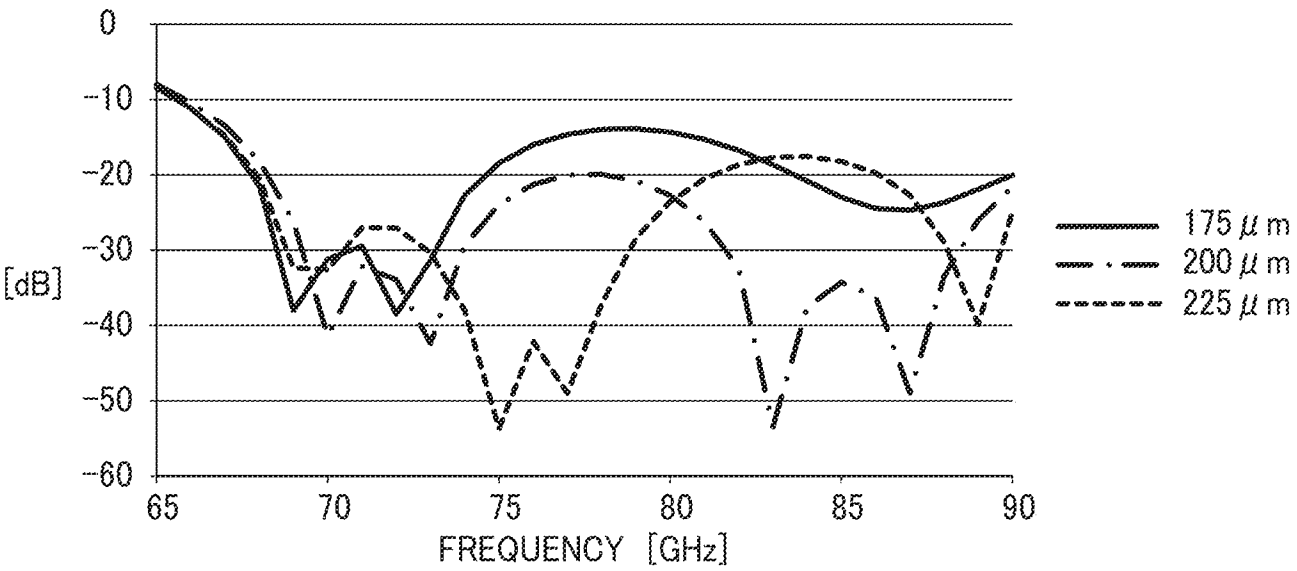
FIG. 18 is a graph illustrating frequency characteristics of the waveguide device according to the eighth embodiment for describing an influence on an input reflection coefficient in a case of changing a projecting conductor in projecting distance.

As apparent from FIG. 18, it can be seen that the frequency characteristics of the waveguide device 100B are affected by the projecting distance from the wide walls 113A and 113B to the tip of the projecting conductor 150.

When the projecting distance from the wide walls 113A and 113B to the tip of the projecting conductor 150 is 175 [μm], the bands in which the input reflection coefficient is −20 [dB] or lower are approximately from 68 to 74 [GHz] and from 84 to 90 [GHz]. When the projecting distance from the wide walls 113A and 113B to the tip of the projecting conductor 150 is 200 [μm], the bands in which the input reflection coefficient is −20 [dB] or lower are approximately from 68 to 77 [GHz] and from 79 to 90 [GHz]. When the projecting distance from the wide walls 113A and 113B to the tip of the projecting conductor 150 is 225 [μm], the bands in which the input reflection coefficient is −20 [dB] or lower are approximately from 68 to 81 [GHz] and from 87 to 90 [GHz].

Hence, it can be seen that by appropriately designing the projecting distance from the wide walls 113A and 113B to the tip of the projecting conductor 150, the band to be used by the waveguide device 100B can be set at a target band.

REFERENCE SIGNS LIST

1, 1A, 1C, 1*a*, 1*b*: Directional coupler;
1B: Waveguide device;
11: Dielectric substrate (dielectric);
12: First conductive layer (wide wall);
13: Second conductive layer;
21 to 24: Post array (narrow wall);
31: First waveguide;
32: Second waveguide;
33: Coupling window;
50: Projecting conductor;
51, 52: Additional conductive post (first projection);
53, 54: Additional conductive post (second projection);
55: Additional conductive post (first central projection);
56: Additional conductive post (second central projection);
61: Conductive post;
62: Conductive post;
100, 100A, 100C: Directional coupler;
100B: Waveguide device;
112A, 112B, 113A, 113B: Wide wall;
121 to 123: Narrow wall;
131: First waveguide;
132: Second waveguide;
133: Coupling window;
150: Projecting conductor;
151, 152: Conductive projection (first projection);
153, 154: Conductive projection (second projection);
155: Conductive projection (first central projection);
156: Conductive projection (second central projection);
160: Short-circuit wall;
200: Diplexer;
201: First filter;
202: Second filter.

The invention claimed is:

1. A directional coupler comprising:

a first waveguide and a second waveguide that are arranged in parallel with a narrow wall therebetween;

a coupling window that is formed in the narrow wall and electromagnetically couples the first waveguide and the second waveguide;

a projecting conductor that projects, at a center in a width direction of the coupling window, from one wide wall of paired wide walls facing each other in the first waveguide and second waveguide, toward an inside of the coupling window, the projecting conductor being spaced from the other wide wall of the paired wide walls, a dielectric;

a first conductive layer and a second conductive layer that face each other with the dielectric therebetween; and three post arrays that penetrate through the dielectric and are electrically connected to the first conductive layer and the second conductive layer, the three post arrays being arranged in parallel to each other, the post arrays each being formed of a plurality of conductive posts, wherein areas, each between post arrays adjacent to each other in the three post arrays, are the first waveguide and the second waveguide, respectively, the first conductive layer and the second conductive layer are the paired wide walls, a central post array in the three post arrays is the narrow wall, and the coupling window is formed in the central post array such that an interval between conductive posts adjacent to each other at a center in an array direction of the central post array is made longer than a pitch between other conductive posts.

2. The directional coupler according to claim 1, further comprising:

paired first conductive projections formed at positions that are respectively closer to two ends of the first waveguide than the coupling window is and that are symmetric with respect to the coupling window, in the narrow wall, the first projections projecting from the narrow wall toward an inside of the first waveguide; and paired second conductive projections formed at positions that are respectively closer to two ends of the second waveguide than the coupling window is and that are symmetric with respect to the coupling window, in the narrow wall, the second projections projecting from the narrow wall toward an inside of the second waveguide.

3. The directional coupler according to claim 2, wherein the first projections extend from one wide wall of the paired wide walls facing each other of the first waveguide toward the other wide wall, to be electrically connected to the one wide wall, and to be spaced from the other wide wall, and the second projections extend from one wide wall of the paired wide walls facing each other of the second waveguide toward the other wide wall, to be electrically connected to the one wide wall and to be spaced from the other wide wall.

4. The directional coupler according to claim 1, further comprising:

a first conductive central projection that projects from a position facing the center in the width direction of the coupling window, in a narrow wall opposite to the narrow wall across the first waveguide, toward the inside of the first waveguide; and a second conductive central projection that projects from a position facing the center in the width direction of the coupling window, in a narrow wall opposite to the narrow wall across the second waveguide, toward the inside of the second waveguide.

5. The directional coupler according to claim 1, further comprising:

a first tapered waveguide and a second tapered waveguide that are respectively connected to an end portion of the first waveguide and an end portion of the second waveguide, wherein a height of the first tapered waveguide is equal to a height of the first waveguide, and a width of the first tapered waveguide gradually increases with distance from the first waveguide, and a height of the second tapered waveguide is equal to a height of the second waveguide, and a width of the second tapered waveguide gradually increases with distance from the second waveguide.

6. A waveguide device comprising:

the directional coupler according to claim 1; and a short-circuit conductor that short-circuits end portions of the first waveguide and the second waveguide, the end portions being on a same side.

7. A diplexer comprising:

two directional couplers according to claim 1, the two directional couplers each being the directional coupler;

a first band-pass filter that is inserted between a first waveguide of one of the two directional couplers and a first waveguide of the other of the directional couplers; and a second band-pass filter that is inserted between a second waveguide of the one directional coupler and a second waveguide of the other directional coupler.

8. A directional coupler comprising:

a first waveguide and a second waveguide that are arranged in parallel with a narrow wall therebetween;

a coupling window that is formed in the narrow wall and electromagnetically couples the first waveguide and the second waveguide;

a projecting conductor that projects, at a center in a width direction of the coupling window, from one wide wall of paired wide walls facing each other in the first waveguide and second waveguide, toward an inside of the coupling window, the projecting conductor being spaced from the other wide wall of the paired wide walls;

paired first conductive projections formed at positions that are respectively closer to two ends of the first waveguide than the coupling window is and that are symmetric with respect to the coupling window, in the narrow wall, the first projections projecting from the narrow wall toward an inside of the first waveguide; and paired second conductive projections formed at positions that are respectively closer to two ends of the second waveguide than the coupling window is and that are symmetric with respect to the coupling window, in the narrow wall, the second projections projecting from the narrow wall toward an inside of the second waveguide, wherein the first projections extend from one wide wall of the paired wide walls facing each other of the first waveguide toward the other wide wall, to be electrically connected to the one wide wall, and to be spaced from the other wide wall, and the second projections extend from one wide wall of the paired wide walls facing each other of the second waveguide toward the other wide wall, to be electrically connected to the one wide wall and to be spaced from the other wide wall.

9. The directional coupler according to claim 8, further comprising:

a first conductive central projection that projects from a position facing the center in the width direction of the coupling window, in a narrow wall opposite to the narrow wall across the first waveguide, toward the inside of the first waveguide; and a second conductive central projection that projects from a position facing the center in the width direction of the coupling window, in a narrow wall opposite to the narrow wall across the second waveguide, toward the inside of the second waveguide.

10. The directional coupler according to claim 8, further comprising:

a first tapered waveguide and a second tapered waveguide that are respectively connected to an end portion of the first waveguide and an end portion of the second waveguide, wherein a height of the first tapered waveguide is equal to a height of the first waveguide, and a width of the first tapered waveguide gradually increases with distance from the first waveguide, and a height of the second tapered waveguide is equal to a height of the second waveguide, and a width of the second tapered waveguide gradually increases with distance from the second waveguide.

11. A waveguide device comprising:

the directional coupler according to claim 8; and a short-circuit conductor that short-circuits end portions of the first waveguide and the second waveguide, the end portions being on a same side.

12. A diplexer comprising:

two directional couplers according to claim 8, the two directional couplers each being the directional coupler;

a first band-pass filter that is inserted between a first waveguide of one of the two directional couplers and a first waveguide of the other of the directional couplers; and a second band-pass filter that is inserted between a second waveguide of the one directional coupler and a second waveguide of the other directional coupler.

13. A waveguide device comprising:

a directional coupler, the directional coupler comprising:

a first waveguide and a second waveguide that are arranged in parallel with a narrow wall therebetween;

a coupling window that is formed in the narrow wall and electromagnetically couples the first waveguide and the second waveguide; and a projecting conductor that projects, at a center in a width direction of the coupling window, from one wide wall of paired wide walls facing each other in the first waveguide and second waveguide, toward an inside of the coupling window, the projecting conductor being spaced from the other wide wall of the paired wide walls; and a short-circuit conductor that short-circuits end portions of the first waveguide and the second waveguide, the end portions being on a same side.

14. The waveguide device according to claim 13, the directional coupler further comprising:

paired first conductive projections formed at positions that are respectively closer to two ends of the first waveguide than the coupling window is and that are symmetric with respect to the coupling window, in the narrow wall, the first projections projecting from the narrow wall toward an inside of the first waveguide; and paired second conductive projections formed at positions that are respectively closer to two ends of the second waveguide than the coupling window is and that are symmetric with respect to the coupling window, in the narrow wall, the second projections projecting from the narrow wall toward an inside of the second waveguide.

15. The waveguide device according to claim 13, the directional coupler further comprising:

a first conductive central projection that projects from a position facing the center in the width direction of the coupling window, in a narrow wall opposite to the narrow wall across the first waveguide, toward the inside of the first waveguide; and a second conductive central projection that projects from a position facing the center in the width direction of the coupling window, in a narrow wall opposite to the narrow wall across the second waveguide, toward the inside of the second waveguide.

* * * * *